US010373429B2

(12) United States Patent
Berman et al.

(10) Patent No.: US 10,373,429 B2
(45) Date of Patent: Aug. 6, 2019

(54) GAMING DEVICE AND SYSTEM FOR USE WITH CAPPED AWARDS

(71) Applicant: KING SHOW GAMES, INC., Minnetonka, MN (US)

(72) Inventors: Bradley Berman, Minnetonka, MN (US); Peter Berman, Minneapolis, MN (US)

( * ) Notice: Subject to any disclaimer, the term of this patent is extended or adjusted under 35 U.S.C. 154(b) by 17 days.

(21) Appl. No.: 15/432,919

(22) Filed: Feb. 14, 2017

(65) Prior Publication Data

US 2017/0236374 A1 Aug. 17, 2017

Related U.S. Application Data

(60) Provisional application No. 62/295,073, filed on Feb. 14, 2016.

(51) Int. Cl.
*A63F 1/00* (2006.01)
*G07F 17/32* (2006.01)

(52) U.S. Cl.
CPC ..... *G07F 17/3244* (2013.01); *G07F 17/326* (2013.01); *G07F 17/3225* (2013.01)

(58) Field of Classification Search
CPC ..... G07F 17/3258; G07F 17/3244
See application file for complete search history.

(56) References Cited

U.S. PATENT DOCUMENTS

| | | | | |
|---|---|---|---|---|
| 8,047,545 | B2 | 11/2011 | Thinnes et al. | |
| 8,496,525 | B2 | 7/2013 | Mosley et al. | |
| 8,613,652 | B2 | 12/2013 | Stanek et al. | |
| 2005/0170881 | A1 | 8/2005 | Muskin | |
| 2006/0089196 | A1* | 4/2006 | Parham | G07F 17/32 463/27 |
| 2010/0019453 | A1 | 1/2010 | Oakes et al. | |
| 2012/0077569 | A1 | 3/2012 | Watkins et al. | |
| 2012/0258783 | A1* | 10/2012 | Chan | G07F 17/34 463/20 |
| 2014/0179396 | A1* | 6/2014 | Aoki | G07F 17/3267 463/20 |

FOREIGN PATENT DOCUMENTS

EP 1607917 A1 12/2005

* cited by examiner

*Primary Examiner* — Omkar A Deodhar
*Assistant Examiner* — Eric M Thomas

(57) ABSTRACT

Embodiments of the present invention set forth systems, apparatuses and methods for enhancing game play of gaming devices with capped awards. Accordingly, a gaming device with capped awards is configured to enhance game play by minimizing or eliminating perceived lost value when an award is capped. To minimizing or eliminate perceived lost value when an award is capped, a remainder amount over a capped amount for an award can be used to modify an aspect of game play in future games played on the gaming device. In conjunction with using the remainder, or alternatively, a point system may be implemented to present awards in points and then convert the points to credits provided to players, where the conversion does not necessitate removing credits that appear to be won due to the cap.

20 Claims, 26 Drawing Sheets

702C

| | | | | | |
|---|---|---|---|---|---|
| ROYAL FLUSH | 100 | 100 | 100 | 100 | 100 |
| STRAIGHT FLUSH | 50 | 100 | 100 | 100 | 100 |
| FOUR OF A KIND | 25 | 50 | 75 | 100 | 100 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

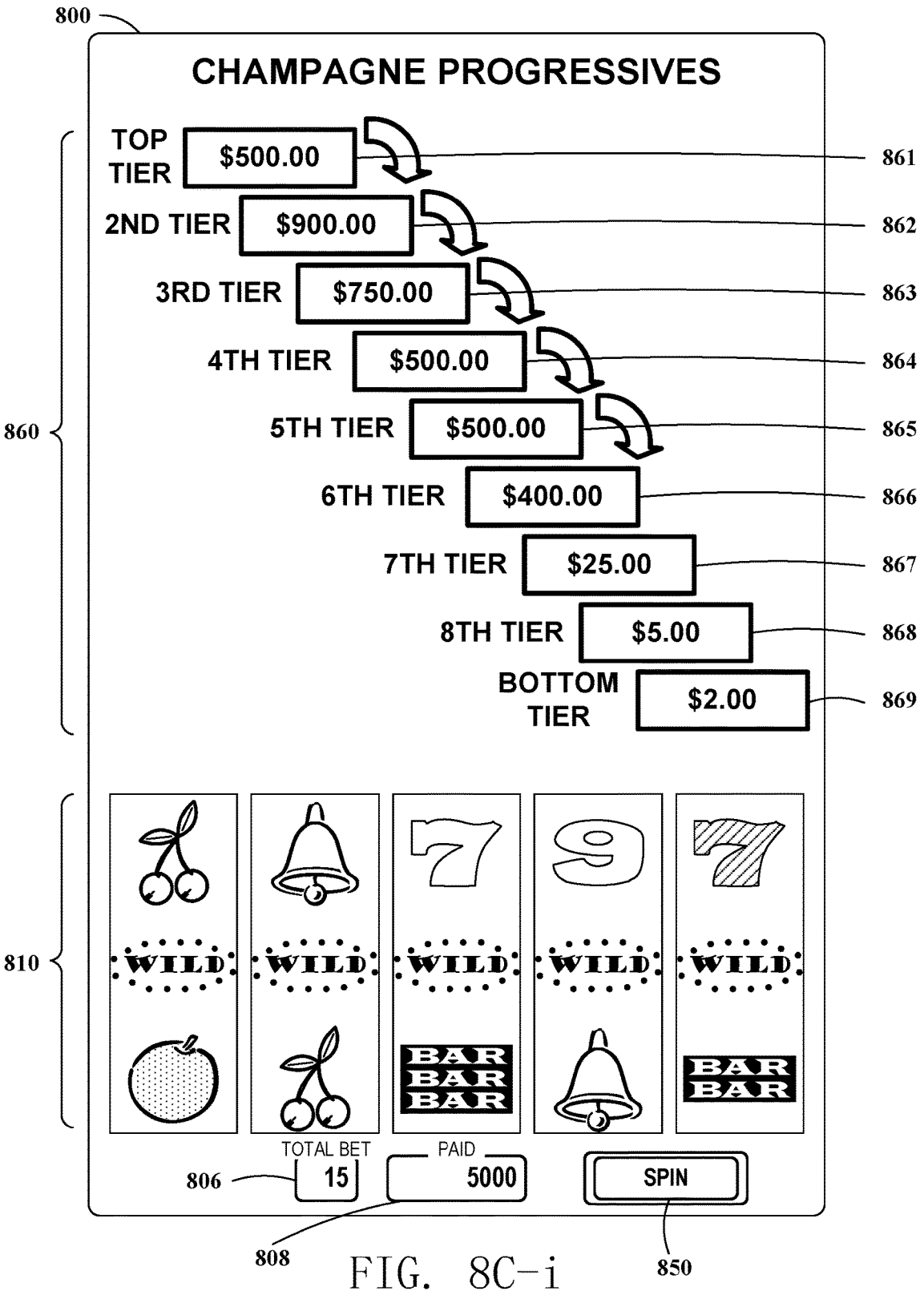
FIG. 8C-i

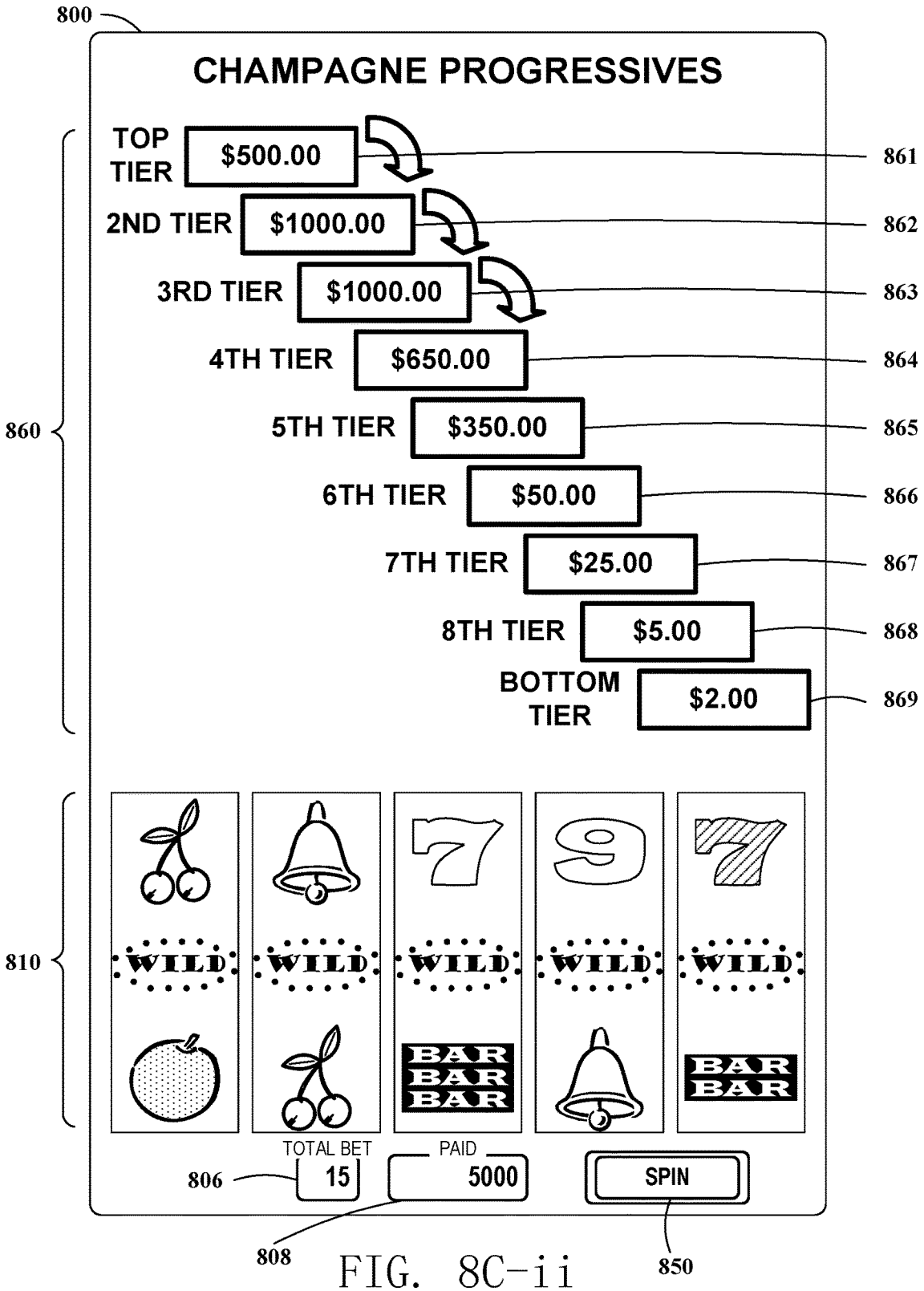
FIG. 8C-ii

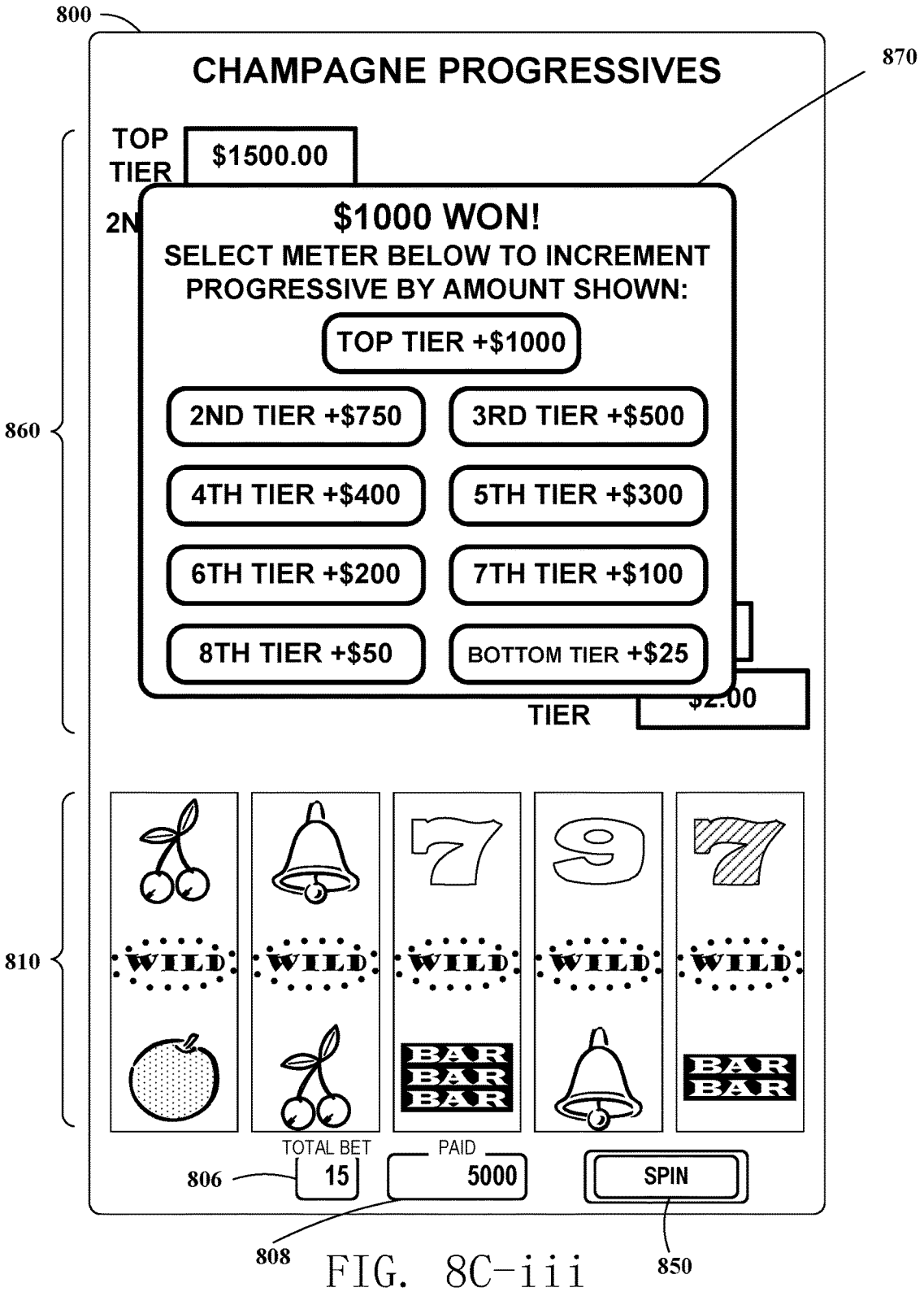
FIG. 8C-iii

GAMING DEVICE AND SYSTEM FOR USE WITH CAPPED AWARDS

RELATED APPLICATIONS

This application claims the benefit of Provisional Patent Application No. 62/295,073, filed on Feb. 14, 2016, to which priority is claimed pursuant to 35 U.S.C. § 119(e) and which is incorporated herein by reference in its entirety.

FIELD OF THE INVENTION

This disclosure relates generally to games, and more particularly to systems, apparatuses and methods for enhancing game play of gaming devices with capped awards.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming" As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

In some gaming markets, awards won on a gaming device must fall below a certain amount for any given wager. However, during the design of a game, awards are commonly provided that exceed these maximum awards allowed in some markets. Although these large awards may have a relatively small chance of being won, game designers either have to design different versions of the game for these markets with maximum award amounts, or cap the amount of the awards won at the maximum value. In either scenario, the play of the game has to be modified from its original design, which could lead to a non-optimized or different gaming experience for players.

The present disclosure describes methods, systems, and apparatus that provide gaming devices and methods to overcome these and other limitations in the prior art.

SUMMARY

To overcome limitations in the prior art described above, and to overcome other limitations that will become apparent upon reading and understanding the present specification, embodiments of the present invention are directed to an apparatus, system, computer readable storage media, and/or method that involve or otherwise facilitate enhancing game play of gaming devices with capped awards. Accordingly, a gaming device with capped awards is configured to enhance game play by minimizing or eliminating perceived lost value when an award is capped. To minimizing or eliminate perceived lost value when an award is capped, a remainder amount over a capped amount for an award can be used to modify an aspect of game play in future games played on the gaming device. In conjunction with using the remainder, or alternatively, a point system may be implemented to present awards in points and then convert the points to credits provided to players, where the conversion does not necessitate removing credits that appear to be won due to the cap.

In some embodiments, a gaming device includes a display, a user interface, a memory configured to store a credit amount, a wager input device structured to receive currency or currency-based tickets, and a processor. The processor is operable to receive a signal from the wager input device indicating receipt of currency or currency based tickets, and increase the credit amount in memory based upon the received signal from the wager input device. Upon receiving another signal indicating a wager amount to initiate a game on the gaming device, the process is further operable to reduce the credit amount by the wager amount and determine if an award is won during play of the initiated game. If an award is won, the processor then determines if an amount of the award is greater than a maximum award value. If the award amount is greater than the maximum value the processor provides the maximum award to the player and increases the credit amount by the amount of the maximum award. In addition, the processor determines the remainder of the award amount over the maximum award and modifies an aspect of the game for one or more future games played on the gaming device based on the determined remainder of the award amount.

In other embodiments, a gaming device includes a display, a user interface, a memory configured to store a credit amount, a wager input device structured to receive currency or currency-based tickets, and a processor. The processor is operable to receive a signal from the wager input device indicating receipt of currency or currency based tickets, and increase the credit amount in memory based upon the received signal from the wager input device. Upon receiving another signal indicating a wager amount to initiate a game on the gaming device, the process is further operable to reduce the credit amount by the wager amount and determine if an award is won during play of the initiated game. If an award is won, the processor presents the award in points. The processor then converts the awarded points into credits using a predefined algorithm. The converted credits are presented to the player and the credit amount in memory is increased by an amount of the converted credits.

In some embodiments, the gaming device may include a setup option in software, or a physical switch that may be activated to change the mode of a game from a first game mode without capped awards to a second game with capped awards, or from the second game mode to the first game mode. The first and second game modes may be stored in the memory of the gaming device or in other memory devices connected to the gaming device. The software setup option or physical switch may be provided so that casino operators, game manufacturing workers, or game engineers can select one of the first or second games modes to be operable on the gaming device depending on the market or jurisdiction that the gaming device is placed, played, or operable.

BRIEF DESCRIPTION OF THE DRAWINGS

FIGS. 8C-i, 8C-ii, and 8C-iii are detail diagrams of the gaming display illustrated in FIGS. 8A and 8B showing alternate example next steps in the game sequence illustrated in FIGS. 8A and 8B according to embodiments of the invention.

DETAILED DESCRIPTION

Figure 1:
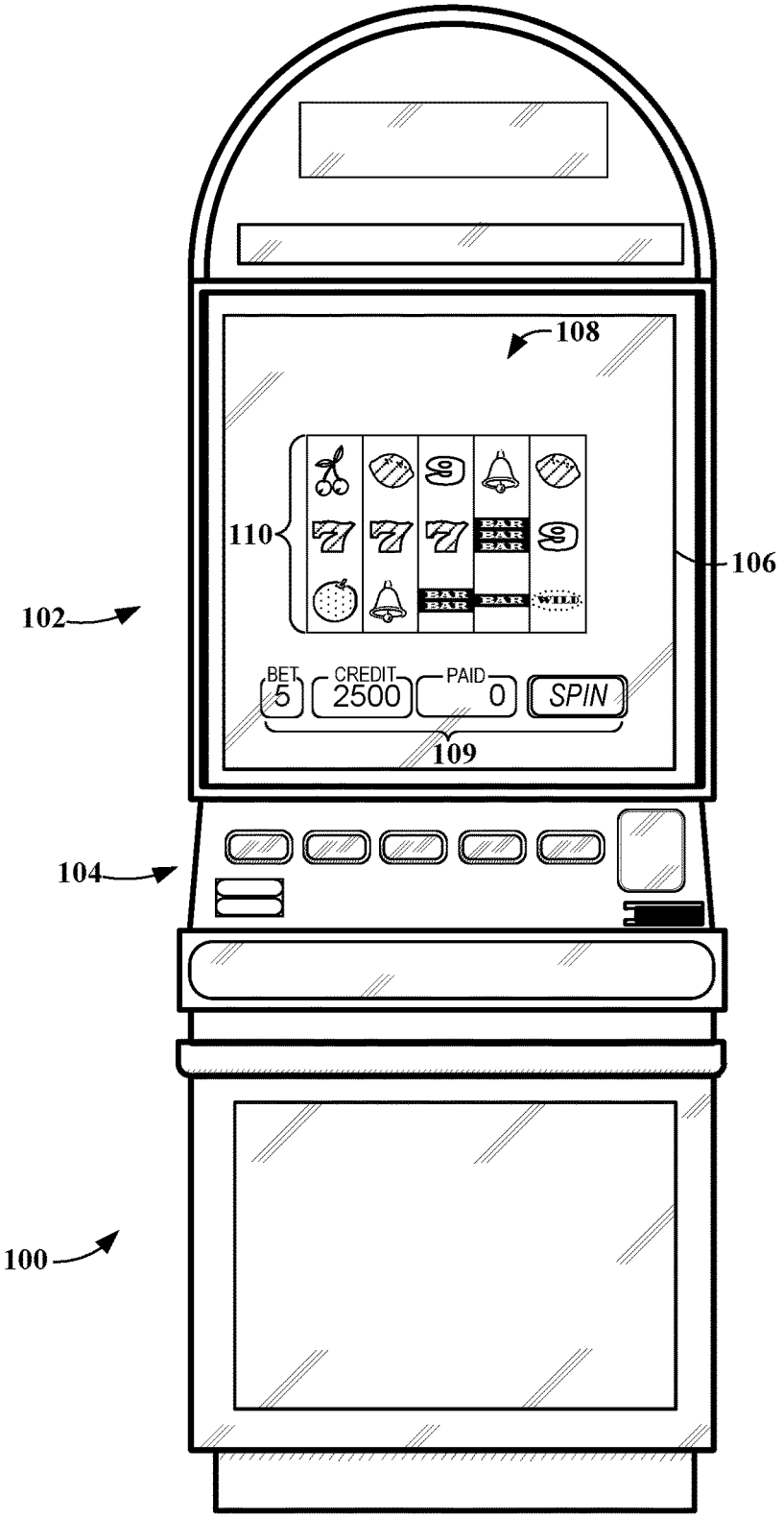
FIG. 1 is a diagram of a gaming machine according to embodiments of the invention.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatus.

In various embodiments of the invention, the gaming displays are described in conjunction with the use of data in the form of "symbols." In the context of this disclosure, a "symbol" may generally refer at least to a collection of one or more arbitrary indicia or signs that have some conventional significance. In particular, the symbol represents values that can at least be used to determine whether to award a payout. A symbol may include numbers, letters, shapes, pictures, textures, colors, sounds, etc., and any combination therebetween. A win can be determined by comparing the symbol with another symbol. Generally, such comparisons can be performed via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for enhancing game play of gaming devices having capped awards. In some embodiments, the systems, apparatuses and methods described herein may use a capped-award remainder to modify an aspect of a single subsequent game on the gaming device, or be implemented to modify an aspect of the game that may span multiple future games. In other embodiments, the systems, apparatuses, and methods described herein may use a point system to present awards in points and then convert the awarded points into credits to ensure that the converted credit amount presented to the player is lower than a win cap.

There are many various manners in which game play may be enhanced in gaming devices having capped awards. Some of these aspects are described in detail below. Further, the disclosure may be applied to any game of chance, and descriptions provided in the context of any representative game below (e.g. a slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide enhanced game play of gaming devices with capped awards. Accordingly, a gaming device with capped awards is configured to enhance game play by minimizing or eliminating perceived lost value when an award is capped. To minimizing or eliminate perceived lost value when an award is capped, a remainder amount over a capped amount for an award can be used to modify an aspect of game play in future games played on the gaming device. In conjunction with using the remainder, or alternatively, a point system may be implemented to present awards in points and then convert the points to credits provided to players, where the conversion does not necessitate removing credits that appear to be won due to the cap.

In some embodiments, a gaming device includes a display, a user interface, a memory configured to store a credit amount, a wager input device structured to receive currency or currency-based tickets, and a processor. The processor is operable to receive a signal from the wager input device indicating receipt of currency or currency based tickets, and increase the credit amount in memory based upon the received signal from the wager input device. Upon receiving another signal indicating a wager amount to initiate a game on the gaming device, the process is further operable to reduce the credit amount by the wager amount and determine if an award is won during play of the initiated game. If an award is won, the processor then determines if an amount of the award is greater than a maximum award value. If the award amount is greater than the maximum value the processor provides the maximum award to the player and increases the credit amount by the amount of the maximum award. In addition, the processor determines the remainder of the award amount over the maximum award and modifies an aspect of the game for one or more future games played on the gaming device based on the determined remainder of the award amount.

In other embodiments, a gaming device includes a display, a user interface, a memory configured to store a credit amount, a wager input device structured to receive currency or currency-based tickets, and a processor. The processor is operable to receive a signal from the wager input device indicating receipt of currency or currency based tickets, and increase the credit amount in memory based upon the received signal from the wager input device. Upon receiving another signal indicating a wager amount to initiate a game on the gaming device, the process is further operable to reduce the credit amount by the wager amount and determine if an award is won during play of the initiated game. If an award is won, the processor presents the award in points. The processor then converts the awarded points into credits using a predefined algorithm. The converted credits are presented to the player and the credit amount in memory is increased by an amount of the converted credits.

In some embodiments, the gaming device may include a setup option in software, or a physical switch that may be activated to change the mode of a game from a first game mode without capped awards to a second game with capped awards, or from the second game mode to the first game mode. The first and second game modes may be stored in the memory of the gaming device or in other memory devices connected to the gaming device. The software setup option or physical switch may be provided so that casino operators, game manufacturing workers, or game engineers can select one of the first or second games modes to be operable on the gaming device depending on the market or jurisdiction that the gaming device is placed, played, or operable.

In some cases, a video slot game imposes a "win cap," a rule whereby if a game's total award exceeds a preset value (the "cap"), then the cap amount is awarded instead. Game designers can impose a win cap in games for a variety of reasons including limiting award amounts intended for specific jurisdictions in order to meet regulatory requirements. However, win caps may be imposed independently of any regulatory requirements, with advantages and disadvantages from a game design or game play perspective. One advantage is that it enables a game designer to increase the frequency of certain game elements (e.g., Wild symbols or bonus initiator symbols, in a video slot game) that provide excitement and anticipation, regardless of the final game outcome. However, win capping, by itself, can make a player feel disappointed when a cap is imposed and the value above the cap (remainder) is effectively taken away without any benefit to the player. Some of the embodiments discussed herein minimize or eliminate this potential disadvantage of a win cap, by using remainders above the cap to provide a benefit in future games, or by using a point system to allow large awards while keeping credits paid below a win cap.

Thus, for example, when set up in a gaming device in a market that allows awards only up to a maximum award value, embodiments of this invention can be implemented in many various manners to use the value of award remainders for awards won that exceed the maximum allowed award value in that jurisdiction to modify an aspect of one or more future games on the gaming device. In some embodiments, the remainder amount may be added to a bonus pot or progressive meter. In other words, the remainder amount would be used to help fund the progressive or bonus pot that may be won in a future game. In other embodiments, the remainder amount may be used to increase the chance of triggering bonus games, increase the prize amounts in bonus games, increase a progressive award reset amount, increase the size of various other game awards, provide award multipliers, or otherwise provide value in one or more future games played on the gaming device. If an embodiment is implemented, where bonus prizes or other features are introduced or increased, these bonus prizes or other features may be won through mystery triggers, by subsymbols (which may be existing in the game or added as part of the remainder bonus), or by associating them with one or more winning triggers already built in the game.

The capped awards, remainder values, and modification of game aspects in future games may be communicated to the player, may be hidden to the player, or may only be partially communicated to the player so they are perceived as mystery prizes. Similarly, the conversion algorithm or process may be communicated to players in embodiments that use the point system, or the conversion algorithm may appear to be a mystery to players. The conversion algorithm may also include elements of randomness to vary the outcome of a point to credit conversion in similar circumstances.

In embodiments where the modification of game aspects in future games is communicated to the player, banner notices, lights, visual cues, and/or sounds may be used to draw the players attention to the modified game aspect. In some of these embodiments, it may be communicated to the player that the modified game aspect was received (at least in part) based on the previous win being larger than an allowed maximum award. In other embodiment, the modified game aspect may be communicated to the player without expressly notifying the player that the modification was a result of an award won that was greater than a an allowed maximum award. In embodiments where the modification is not communicated to the player, a triggered bonus, higher progressive award reset, different award values associated with certain wins, or game multipliers may appear as mystery awards without direct notification of why the modification was provided.

In various embodiments, the modification of a game aspect for one or more future games may be provided only for the next played game on the gaming device, may be provided for multiple consecutive games played on the gaming device, may be randomly activated for one or more future games played on the gaming device, may be activated after one or more subsequent games have been played, or may be active in future games according to a different scheme.

As discussed above, some embodiments of this invention provide a set of alternatives for awarding prizes in gaming systems, including a generalization of "win capping" that provides the benefits of that mechanic while mitigating its drawbacks. In some embodiments, meeting or exceeding the win cap awards a credit value or initiates a feature, while in other embodiments, credits are not awarded directly but rather through a system of "points," with a lookup table or other rules used to translate points to credits. A points system can be used to serve the same function as a win cap, but roll remainders into a capped win by providing an algorithm or mechanic to convert points awarded to actual credits won. Some of these embodiments of point systems can eliminate credit remainders that stretch to future games, while other embodiments of these point systems can combine the use of points with remainders used in future games. Thus, a points system may be used creatively in other ways to create new gaming experiences.

In some embodiments, a game with a win cap is enhanced such that if the win cap is met or exceeded, the game awards the amount of the win cap plus an additional prize. The additional prize may be either a fixed credit value or initiation of some feature. For example, a game may have a win cap of 50,000 credits, with an extra award of 20,000 credits for meeting or exceeding the cap. Here, if the game would award 72,000 credits absent the cap, then the game instead awards 70,000 credits. Likewise, a game that would award 53,000 credits would instead award 70,000 credits. This gives the player at least some type of extra award for meeting or exceeding the cap; moreover, in many cases, the extra award actually increases the player's total pay.

In other embodiments, a game may present outcomes award in "points" instead of credits, where a lookup table, algorithm, or other method is used to translate points to credits at the end of the game. In one example, a multi-line or Multiway video slot game may be played in which certain symbol combos award points according to a pay combos table. If the total points awarded are less than 50,000, then a credit value is awarded in an amount equal to the total points awarded. If the total points awarded are 50,000 or greater, then a total of 70,000 credits are awarded. From a mathematical perspective, this example is similar to the example given above. The difference lies in how the game sets the player's expectations. In the "points" embodiment, at no point does the game display a credit value that is then reduced. This may be advantageous from a player experience perspective.

In another example, a game is configured in which the first 100,000 points translate to credits as 1 credit for every 10 points; the next 100,000 points translate 1-to-1 as credits; and any additional points award no credits at all. Alternatively, a predefined conversion algorithm may include randomly assigning a credit value between 1 and 10 for each 100 points awarded for a winning outcome. In other embodiments, a conversion process may include awarding credits on a 1-to-1 basis for the first 1000 points; awarding credits on a 1-to-10 basis for the next 10,000 points, awarding credits on a 1-to-100 basis for the next 100,000 points, and awarding credits on a 1-to-1000 basis thereafter. Many other conversion algorithms are possible. An unconventional points-to-credits table similar to the ones described herein may enable game designers to vary the ways in which exciting game outcomes are delivered.

In some embodiments, a game that awards points in amounts that are not always multiples of 5 or 10, where in fact the units digit of the points total shows unpredictability from one game to the next. Points translate to credits as 1 credit for every 10 points. Moreover, if the units digit of the points total is a certain value (say, 7), then an additional prize is awarded. This additional prize could be a credit award, a random multiplier, or some other feature initiation.

In other embodiments, a video slot game awards "blue points" for pay combos involving blue symbols and "green points" for pay combos involving green symbols. Ordinarily, the game awards credits in an amount equal to the maximum of the blue points score and the green points score. If a scatter combo appears in the game window, then the game awards the sum of the blue points and the green points.

With these and other embodiments, it is possible for a game with a win cap to award the amount of the win cap (in credits) plus a feature initiation if the win cap (in credits or points, depending on the embodiment) is met or exceeded. For example, the feature could be an award of one or more free games or, alternatively, one or more "fever games" (in which a bet is required but the expected return on a given bet is substantially greater than 100%). The number of free or fever games initially awarded may depend on the amount by which the win cap is exceeded.

Numerous other variations are possible using these and other embodiments of the inventive concept. Some of these embodiments and variations are discussed below with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, or other games of chance. Some of these other types of embodiments will be discussed below as variations to the examples illustrated. However, many other types of games can implement similar techniques and fall within the scope of this inventive concept.

Referring to the example gaming apparatus 100 shown in FIG. 1, the gaming apparatus includes a display area 102 (also referred to as a gaming display), and a player interface area 104, although some or all of the interactive mechanisms included in the user interface area 104 may be provided via graphical icons used with a touch screen in the display area 102 in some embodiments. The display area 102 may include one or more game displays 106 (also referred to as "displays" or "gaming displays") that may be included in physically separate displays or as portions of a common large display. Here, the game display 106 includes a primary game play portion 108 that displays game elements and symbols 110, and an operations portion 109 that can include meters, various game buttons, or other game information for a player of the gaming device 100.

The user interface 104 allows the user to control and engage in play of the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, or any other user input system or mechanism that allows the user to play the particular gaming activity.

The user interface 104 may allow the user or player to enter coins, bills, or otherwise obtain credits through vouchers, tokens, credit cards, tickets, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player loyalty information to identify a user or player of the gaming device. This mechanism may be card reader, biometric scanner, keypad, or other input device. It is through the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touchscreen, entering text, entering voice commands, or other known data entry methodology.

The game display 106 in the display area 102 may include one or more of an electronic display, a video display, a mechanical display, and fixed display information, such as paytable information associated with a glass/plastic panel on the gaming machine 100 and/or graphical images. The symbols or other indicia associated with the play of the game may be presented on an electronic display device or on mechanical devices associated with a mechanical display. Generally, the display 106 devotes the largest portion of viewable area to the primary gaming portion 108. The primary gaming portion 108 is generally where the visual feedback for any selected game is provided to the user. The primary gaming portion 108 may render graphical objects such as cards, slot reels, dice, animated characters, and any other gaming visual known in the art. The primary gaming portion 108 also typically informs players of the outcome of any particular event, including whether the event resulted in a win or loss.

In some the example embodiments illustrated herein, the primary gaming portion 108 may display a grid (or equivalent arrangement) of game elements 110 or game element positions (also referred to as "reel stop positions" herein). As illustrated in the embodiment shown in FIG. 1, the grid includes three rows and five columns of game elements 110, which may form a game outcome of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as paytables, navigation controls, etc.

Figure 2:
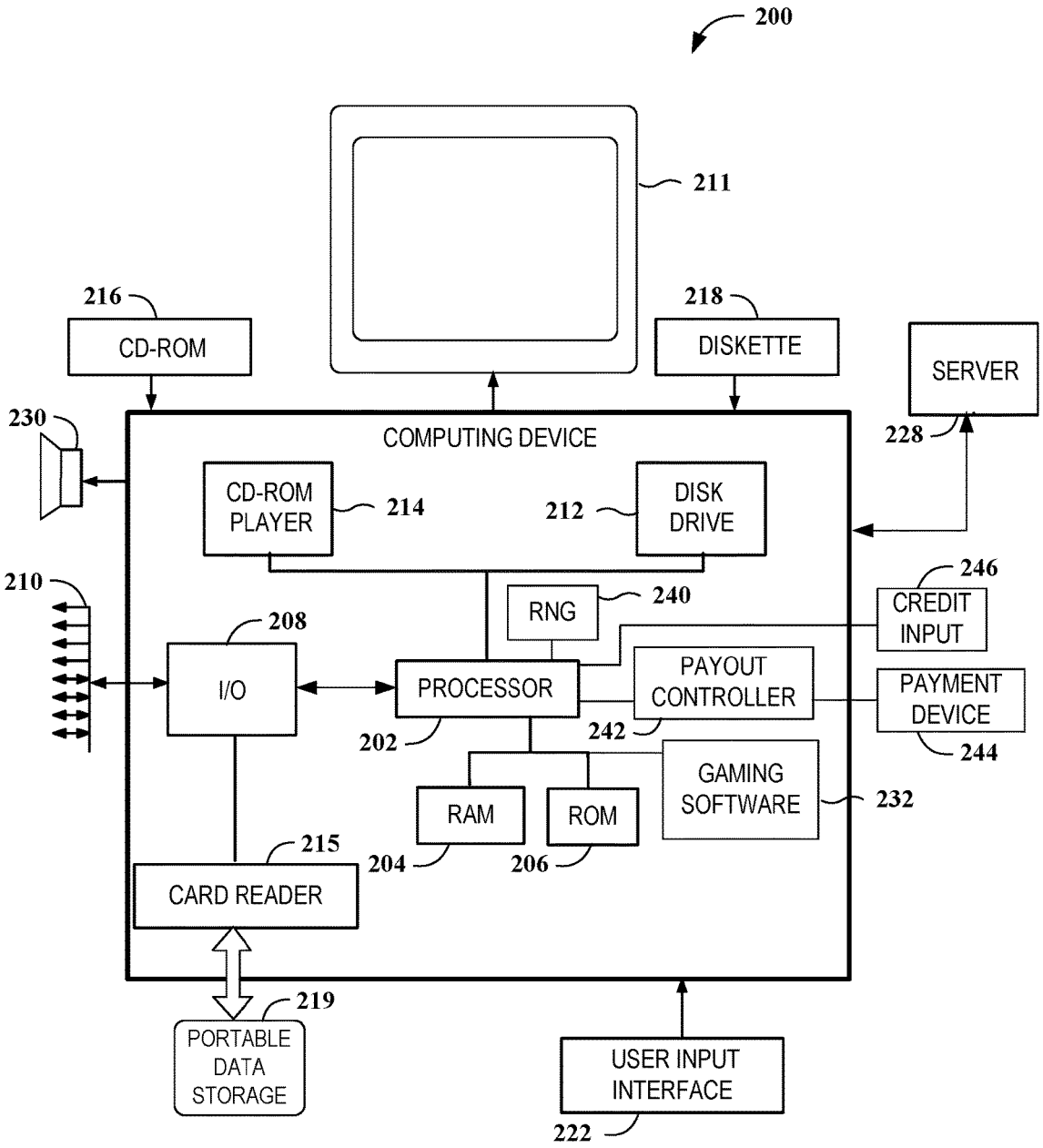
FIG. 2 is a block diagram illustrating a computing arrangement according to embodiments of the invention.

Although FIG. 1 illustrates a particular implementation of some of the embodiments of this invention in a casino or electronic gaming machine ("EGM"), one or more devices may be programmed to play various embodiments of the invention. The present invention may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the invention is illustrated in FIG. 2.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 200 of FIG. 2 is an example computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions in accordance with the present invention typically includes a central processor (CPU) 202 coupled to random access memory (RAM) 204 and some variation of read-only memory (ROM) 206. The ROM 206 may also represent other types of storage media to store programs, such as programmable ROM (PROM), erasable PROM (EPROM), etc. The processor 202 may communicate with other internal and external components through input/output (I/O) circuitry 208 and bussing 210, to provide control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to the display 211, which represents a display on which the gaming activities in accordance with the invention are presented. The display 211 represents the "presentation" of the game information in accordance with the invention, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, or inputting data to identify a player for a player loyalty system. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG). The fixed and dynamic symbols generated as part of a gaming activity may be produced using one or more RNGs. RNGs may be implemented using hardware, software operable in connection with the processor 202, or some combination of hardware and software. The present invention is operable using any known RNG, and may be integrally programmed as part of the processor 202 operation, or alternatively may be a separate RNG controller 240. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout device 244 may also be provided in gaming machine embodiments, where the payout device 244 serves as the mechanism providing the payout to the player or participant. In some embodiments, the payout device may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, etc., for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payout device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described hereinabove. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a paytable. The software 232 may include instructions to provide other functionality as known in the art or as described and shown herein.

Figure 3:
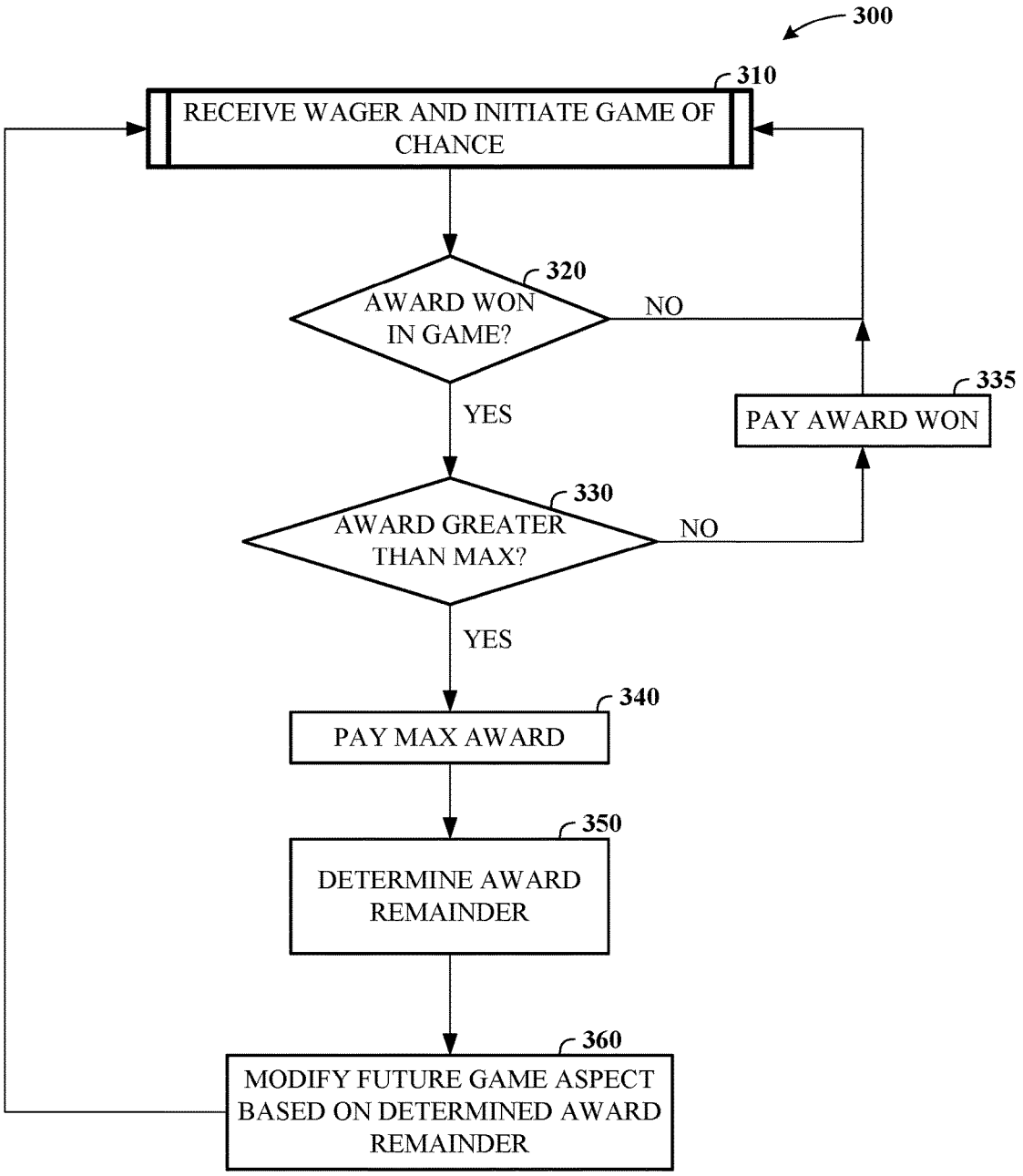
FIG. 3 is a flow diagram illustrating a method of using a gaming device or system to use remainders of capped awards according to embodiments of the invention.
Figure 10:
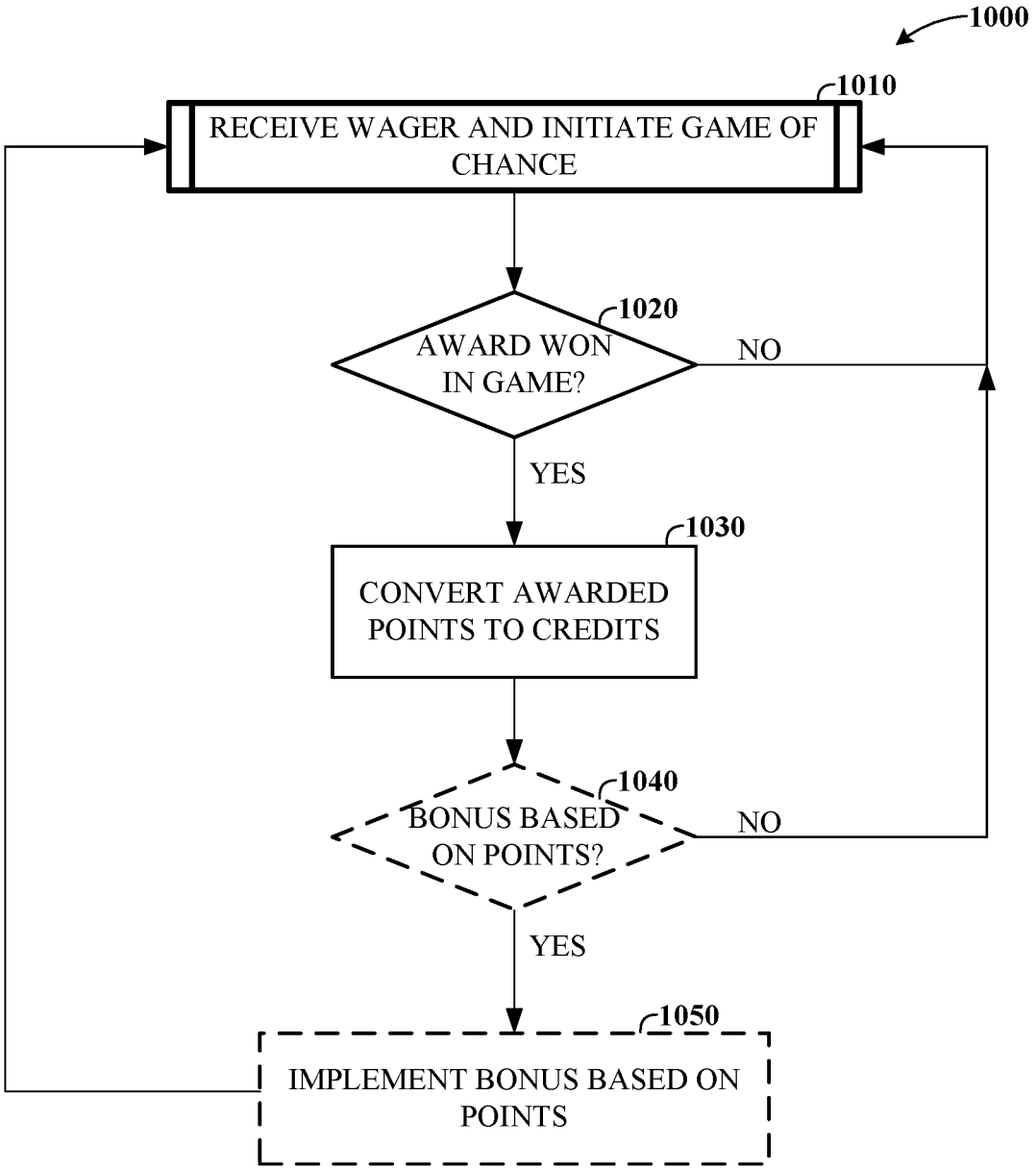
FIG. 10 is a flow diagram illustrating a method of using a gaming device or system to implement a point mechanic for capped awards according to embodiments of the invention.

FIGS. 3 and 10 are flow diagrams representing methods in which a gaming device and/or gaming system can be operated according to embodiments of the invention. Although various processes are shown in a particular order in these flow diagrams, the order of these processes can be changed in other embodiments without deviating from the scope or spirit of this concept. Hence, the order of the processes shown is for illustrative purposes only and is not meant to be restrictive. Additional game processes may also be included between various processes even though they are not shown in these flow diagrams for clarity purposes. Further each of the processes may be performed by components in a single game device, such as by a game processor, or may be performed in part or whole by a remote server or processor connected to the gaming device via a network. Each process may be encoded in instructions that are stored in a memory, a computer-readable medium, or another type of storage device. Note that these example methods are just some embodiments of how the steps of a game operation can be implemented. As discussed and shown above, many variations exist which may require additional, fewer, or different processes to complete.

Referring to FIG. 3, flow 300 begins at process 310 where a wager is received and a game of chance is initiated on a gaming device. This process may include receiving signals that a wager has been placed on the game of chance and reducing credit amount stored in a memory of the gaming device by the amount wagered. In process 320, the gaming device determines is an award has been won during play of the game of chance. Process 320 may include randomly determining a game outcome for the game of chance using a random number generator, and evaluating game symbols that appear in a game grid (such as slot symbols visible in a symbol position, cards in a video poker hand, or other game indicia in a game outcome) to determine if an award is associated with any combinations in the game grid using a predetermined paytable. If an award is not won, flow 300 returns to process 310 to await the receipt of another wager, another game trigger, or a player command. If an award is won as determined in process 320, flow 300 proceeds to process 330 to determine if the award won is greater than a predefined maximum award. If the award won for the game is less than the predefined maximum award, flow 300 proceeds to process 335 whether the award for the game in provided to the player, such as by, for example, increasing the credit amount stored in the memory of the gaming device by the award amount. After process 335, flow 300 returns to process 310 to await the receipt of another wager, another game trigger, or a player command.

On the other hand, if the award won is greater than the predefined maximum award as determined in process 330, flow 300 proceeds to process 340 where the maximum award is provided to the player, such as by, for example, increasing the credit amount stored in the memory of the gaming device by the maximum award amount. In some embodiments, the award provided to the player in process 340 may not be equal to the predefined maximum award. This may be because of denomination played, may be to facilitate a particular modification based on the award remainder, or the amount awarded may simply be specified as less than the predefined maximum award amount. In process 350, the award remainder is determined. Here, the award remainder may be the difference between the award associated with the game outcome and the award provided in process 340, or some rounding may be used to adjust the value of the remainder. In some embodiments, the amount of the remainder may be converted to different units. For example, in one embodiment each 50 credits won over the maximum value may be used to increment a bonus meter toward a guaranteed bonus. In other embodiments, the amount of the remainder may not important. In these instances, process 350 may be used to determine that there is a remainder; i.e., a binary determination. In process 360, an aspect of one or more future games is modified based on the remainder. As discussed above and below, this modification aspect can take many different forms in different embodiments. After the aspect has been modified, flow 300 returns to process 310 to await the receipt of another wager, another game trigger, or a player command.

FIGS. 4A-4D, 5A-5D, and 6A-6G are detail diagrams of a gaming display showing example game sequences that uses remainders of capped awards in future games according to embodiments of the invention.

Figure 4A:
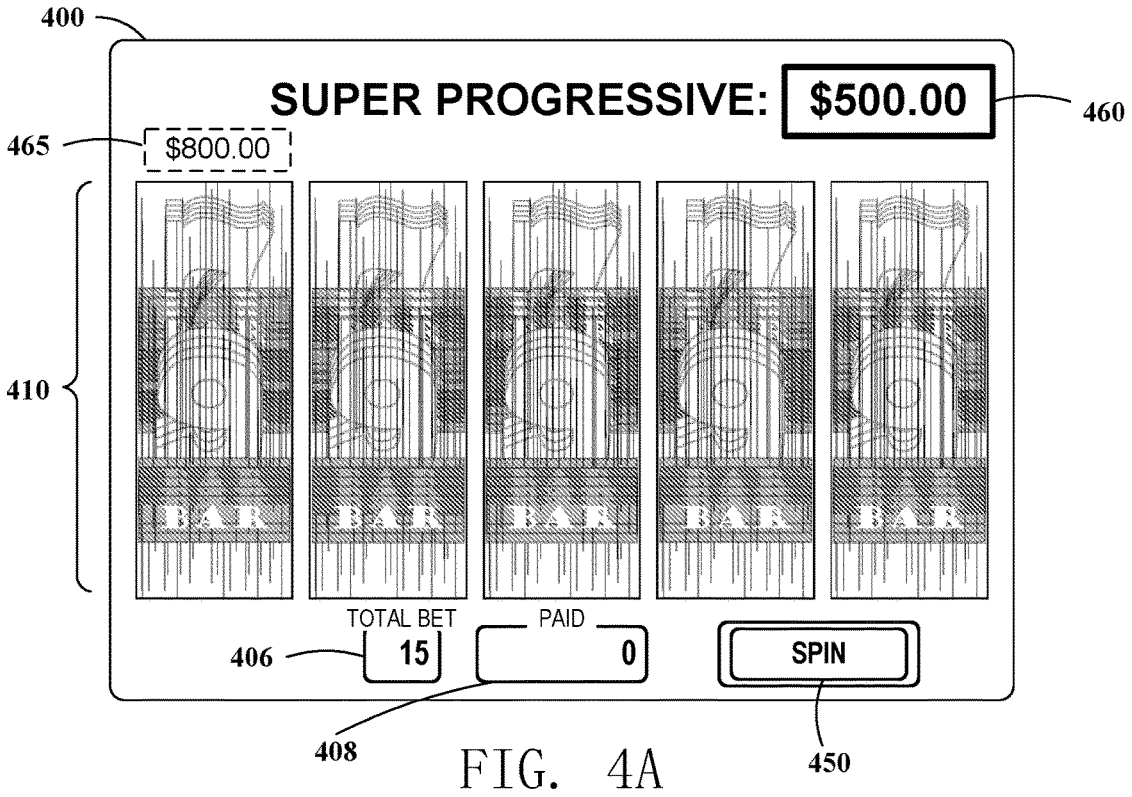
FIGS. 4A, 4B, 4C, and 4D are detail diagrams of a gaming display showing an example game sequence that uses remainders of capped awards in future games according to embodiments of the invention.
Figure 4B:
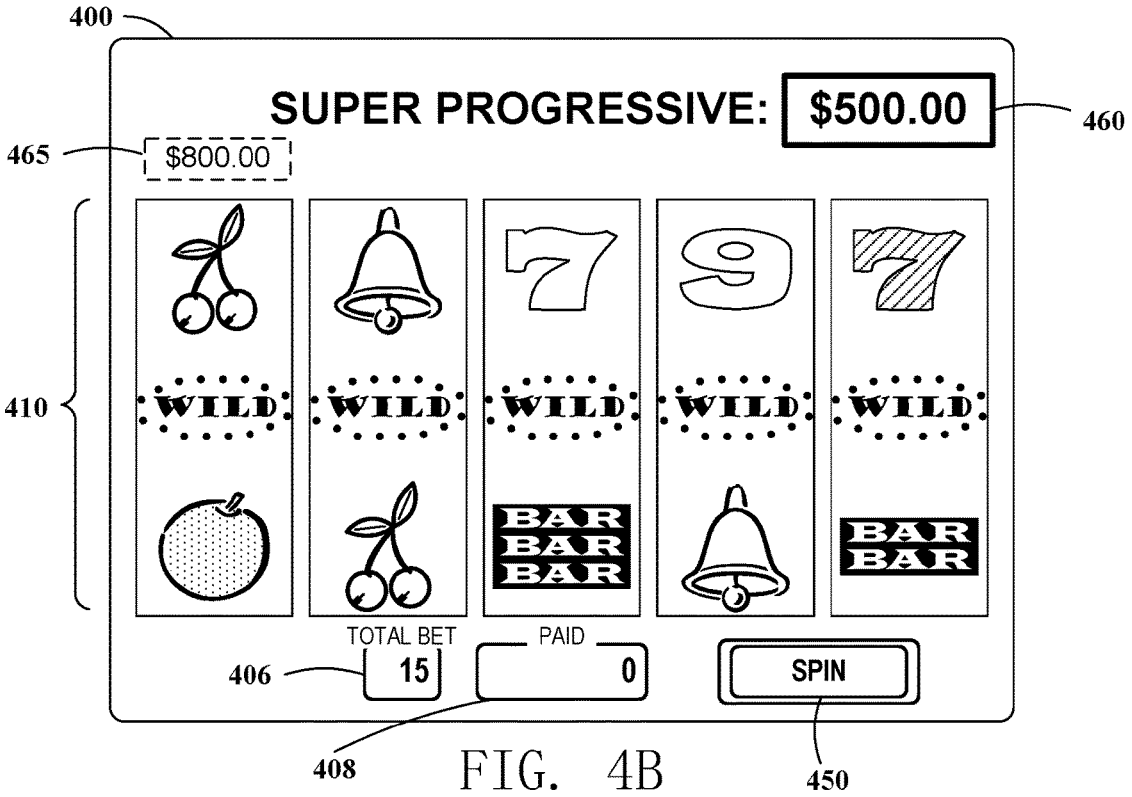
Figure 4C:
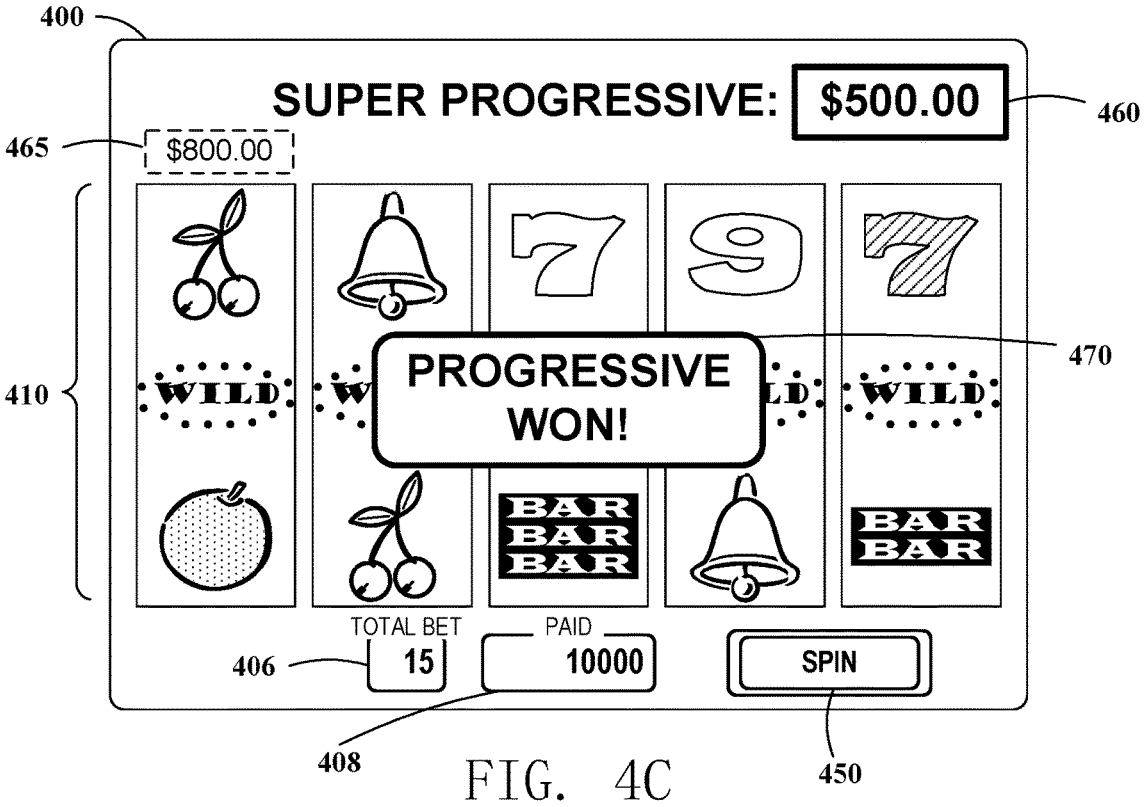
Figure 4D:
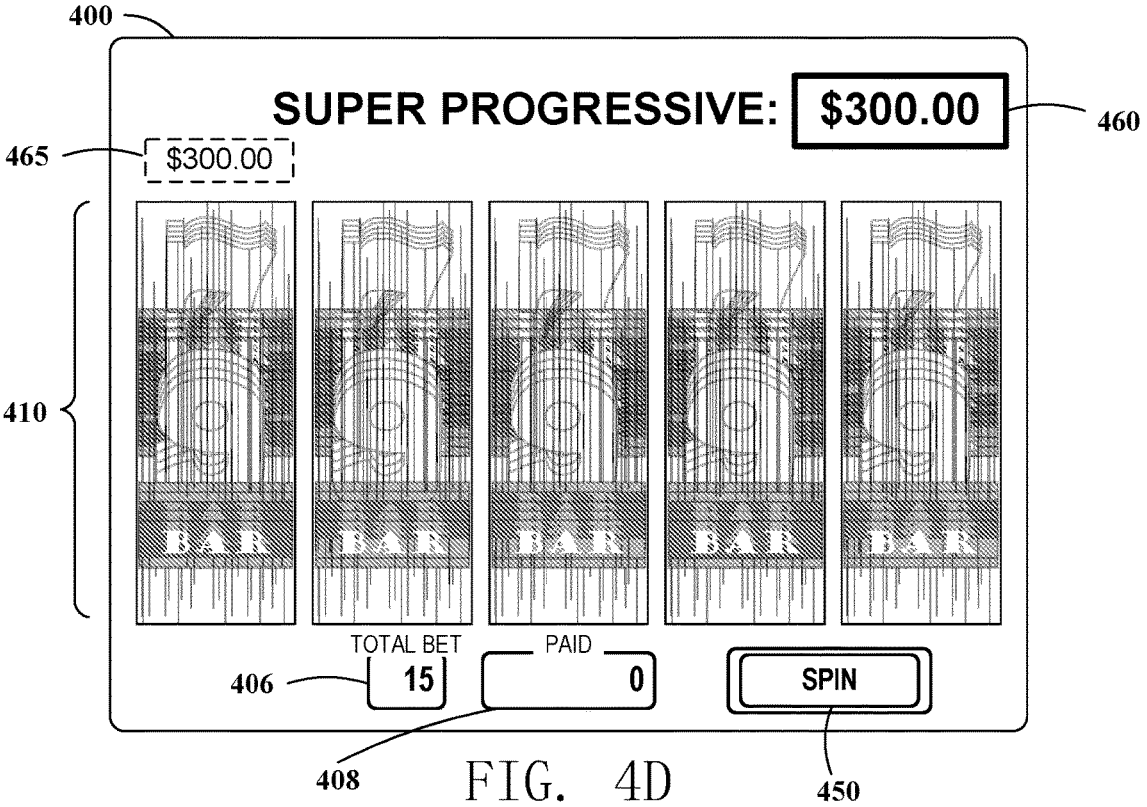

Referring to FIGS. 4A-4D, a gaming display 400 includes a game grid 410 that includes five game reels each having multiple game symbols. A player interface portion of the display 400 includes meters and interactive buttons, such as Total Bet Meter 406, Paid Meter 408, and Spin Button 450. In this embodiment, the display 400 also includes a progressive award meter 460. Progressive meter 465 is stored in memory and is not visible on the display 400. Progressive meter 465 tracks the actual built up amount of a progressive award, even if that amount goes above a maximum allowed award. As shown in FIG. 4A, the Progressive Award Meter 460 shows a maximum allowed award of $500.00, but the progressive meter 465 in memory indicates the progressive amount has a value of $800. In FIG. 4B, the game outcome on the game grid 410 shows a game outcome associated with winning the progressive amount. In FIG. 4C, an award notification 470 informs the player that they won the award, and player wins the maximum award amount, i.e., the amount shown in Progressive Award Meter 460. This win is shown in credits in the Paid Meter 408. In this embodiment, when a progressive is awarded, the progressive meter typically resets to $0 and gets built up again over time from wager contributions until it is won. However, as shown in FIG. 4D, both the Progressive Award Meter 460 and the progressive meter 465 in memory are reset to $300, which is the remainder amount between the actual progressive value stored in the progressive meter 465 ($800) and the maximum allowed award for that market ($500).

Figure 5A:
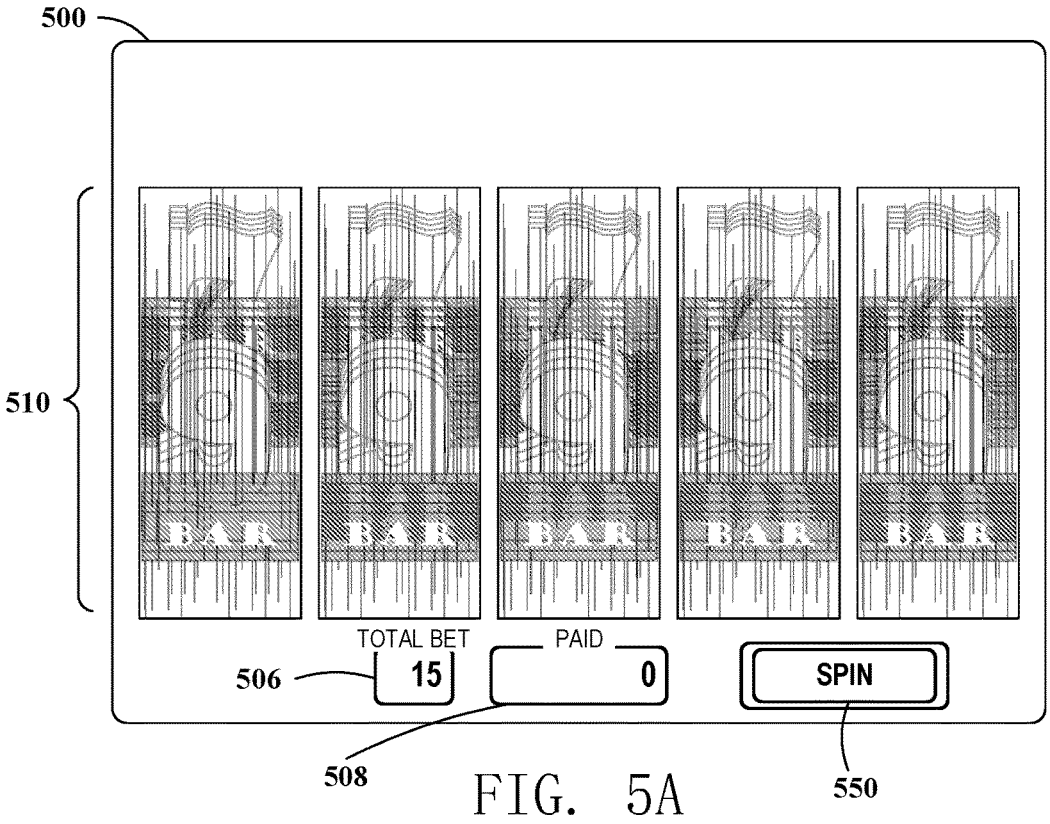
FIGS. 5A, 5B, 5C, and 5D are detail diagrams of a gaming display showing another example game sequence that uses remainders of capped awards in future games according to embodiments of the invention.
Figure 5B:
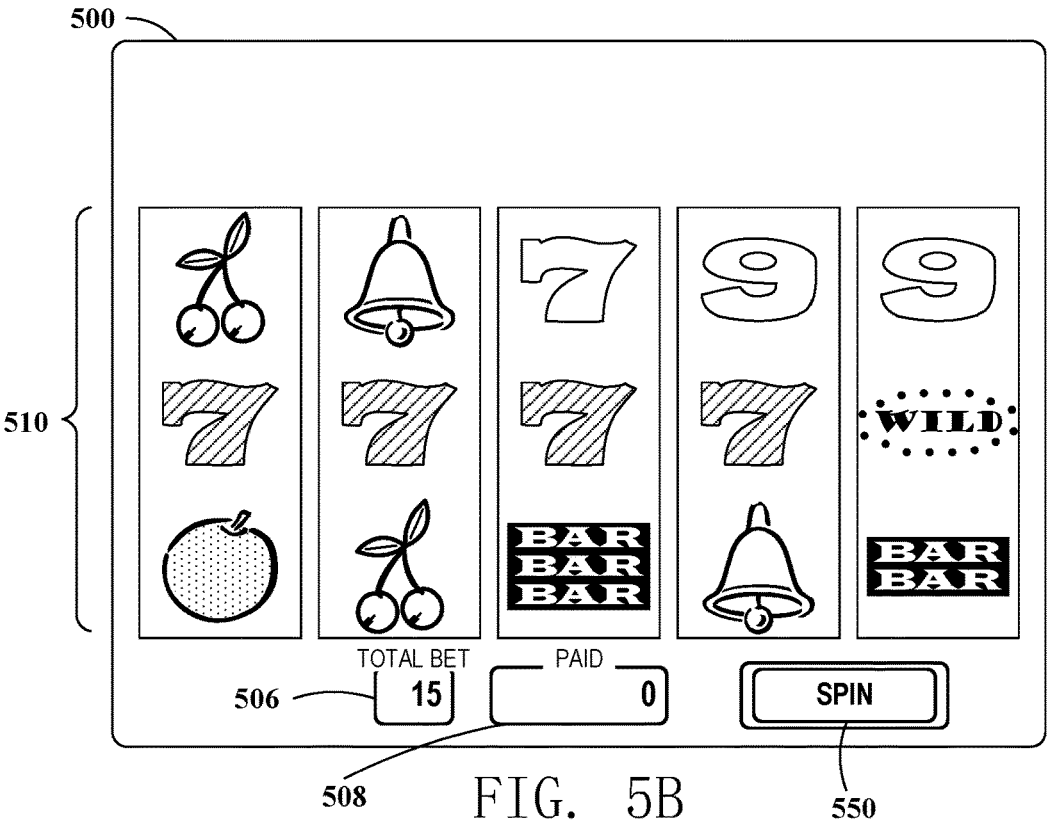
Figure 5C:
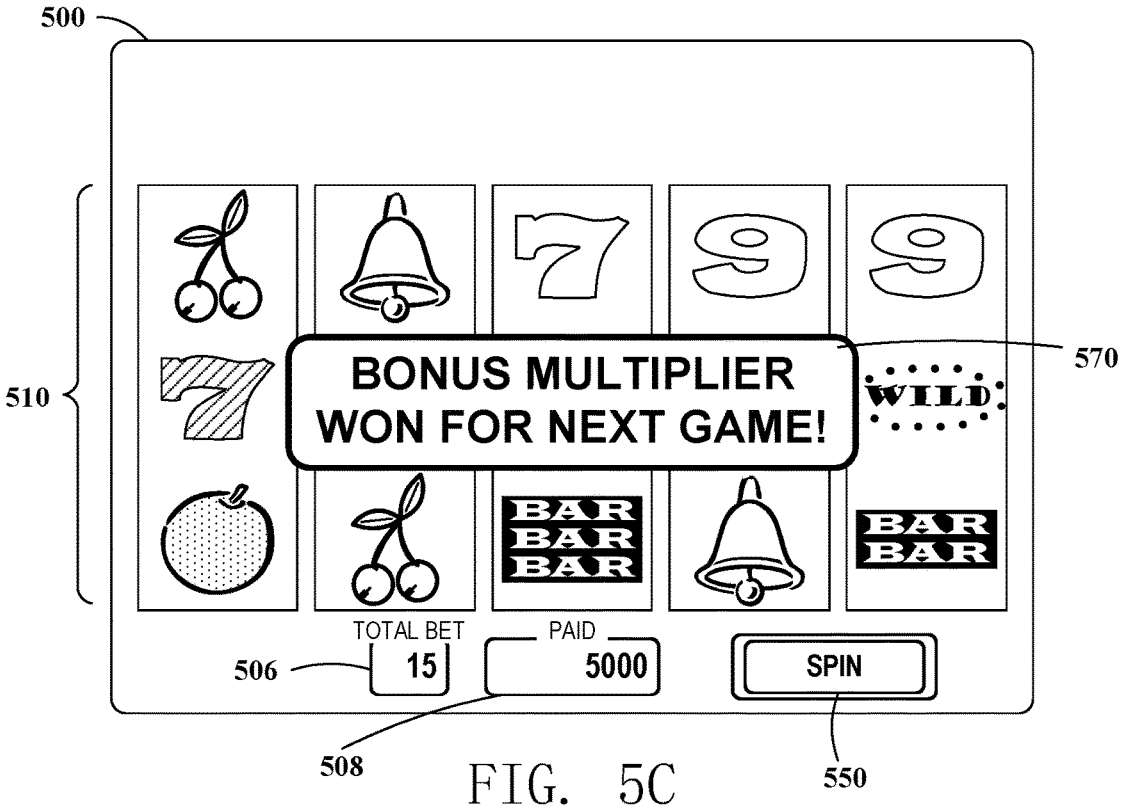
Figure 5D:
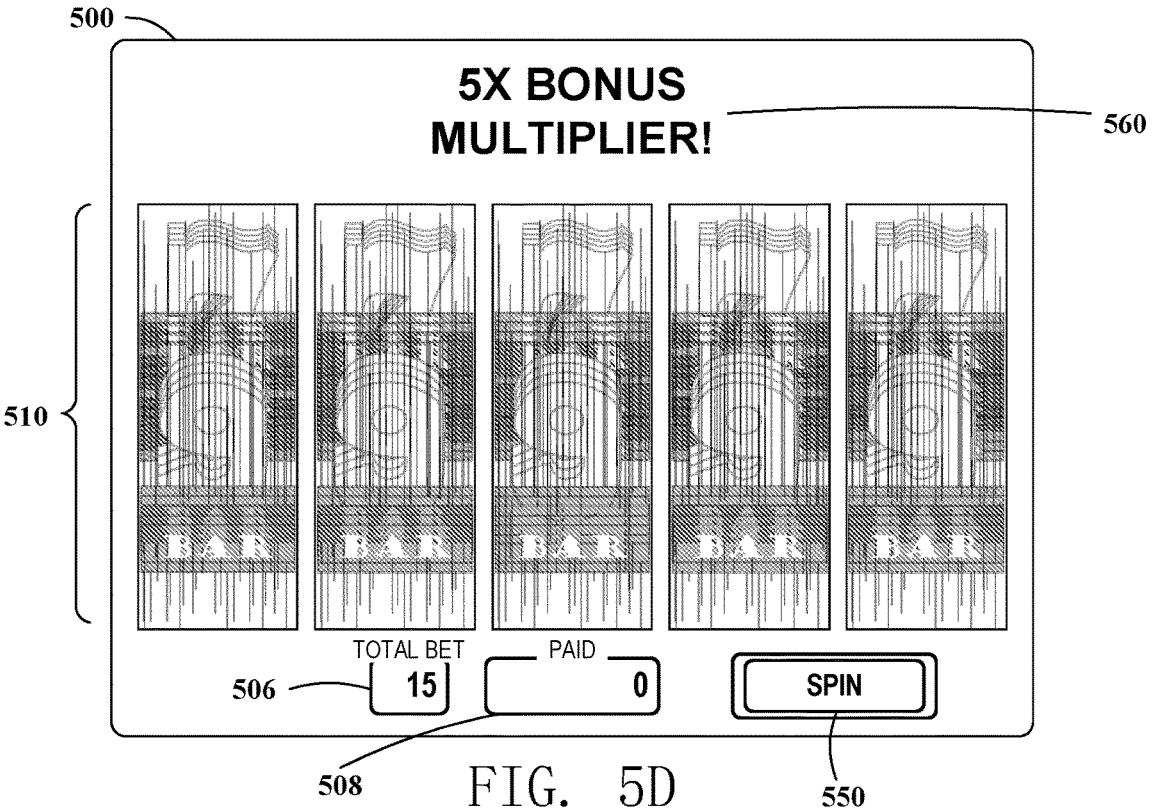

Referring to FIGS. 5A-5D, a gaming display 500 includes a game grid 510 that includes five game reels each having multiple game symbols. A player interface portion of the display 500 includes meters and interactive buttons, such as Total Bet Meter 506, Paid Meter 508, and Spin Button 550. In FIG. 5A the player plays a game of chance on the gaming device. In FIG. 5B, the outcome of the game of chance is shown on the game grid 510. Here, the player has received a winning combination of 5 shaded-7 symbols. In this embodiment, the award associated with the received winning combination exceeds the maximum allowed value in the particular gaming market. As shown in FIG. 5C, a notification 570 indicates that the player has won a bonus multiplier for the next game. In FIG. 5D, the bonus multiplier of "5×" is displayed in a notification area 560 of the display 500. Here, any wins occurring in this subsequent game will have associated awards multiplied by the "5×" multiplier. In some embodiments, the value of the multiplier awarded may be associated with the amount of the remainder determined as the difference between the value of the winning symbol combination and the maximum allowed win amount.

Referring to FIGS. 6A-6G, a gaming display 600 includes a game grid 610 that includes five game reels each having multiple game symbols. A player interface portion of the display 600 includes meters and interactive buttons, such as Total Bet Meter 606, Paid Meter 608, and Spin Button 650. In this embodiment, the display 600 also includes a bonus award meter 660. The bonus award meter 660 includes a number of segments, where a bonus is awarded if all of the segments are marked or otherwise activated. Although the bonus award meter 660 is shown in this embodiment as a plurality of segments, it may be a numeric meter, proximity meter, dial, or any other type of meter that shows progress toward a goal. The bonus associated with the bonus award meter 660 may be automatically triggered the game after the top or end portion of the meter is reached. The bonus associated with the bonus award meter 660 may be independently triggered by a symbol combination in the game, by a mystery trigger, or by another trigger during game play in addition to being triggered by the bonus meter. Segments, sections, or other discernable values associated with the bonus meter may be marked or activated when an award is won during game play that exceeds a win cap value. The number of segments, sections, or other discernable values associated with the bonus meter 660 to be marked may be directly correlated to the amount of a prize over the win cap, or any win over the win cap may mark or activate a set number of segments, sections, or values within the bonus meter.

Figure 6A:
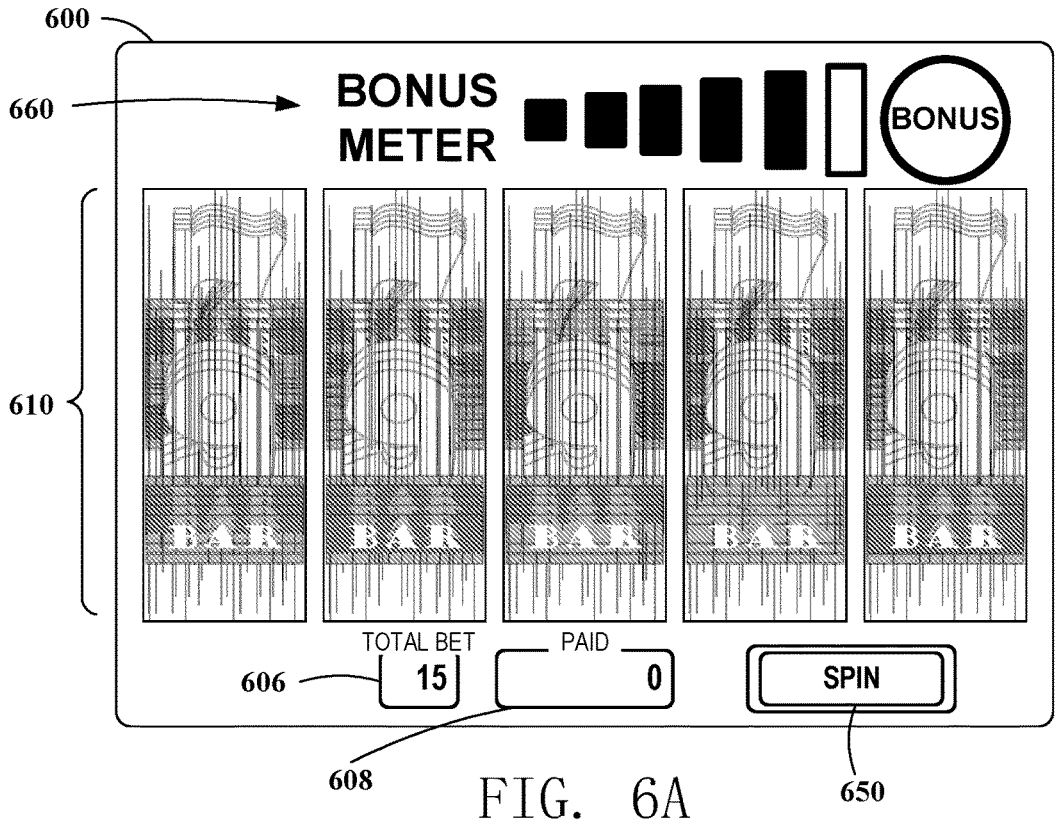
FIGS. 6A, 6B, 6C, 6D, 6E, 6F, and 6G are detail diagrams of a gaming display showing another example game sequence that uses remainders of capped awards in future games according to embodiments of the invention.
Figure 6B:
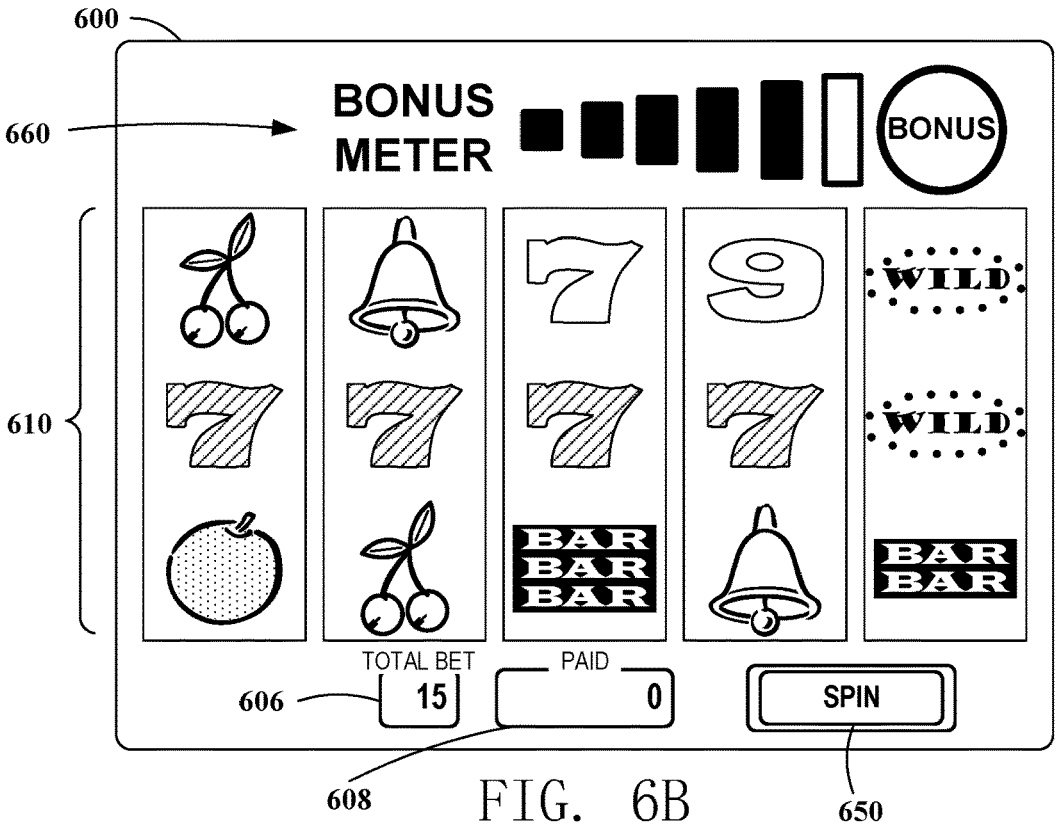
Figure 6C:
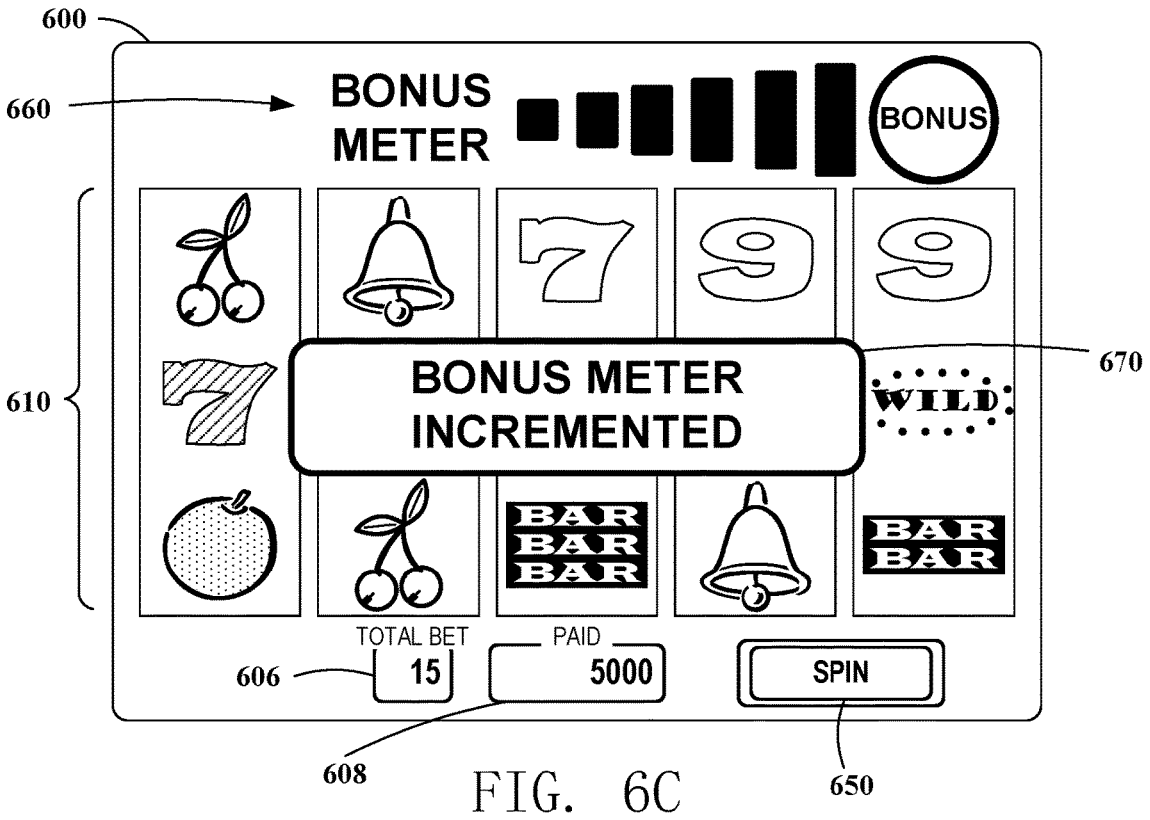
Figure 6D:
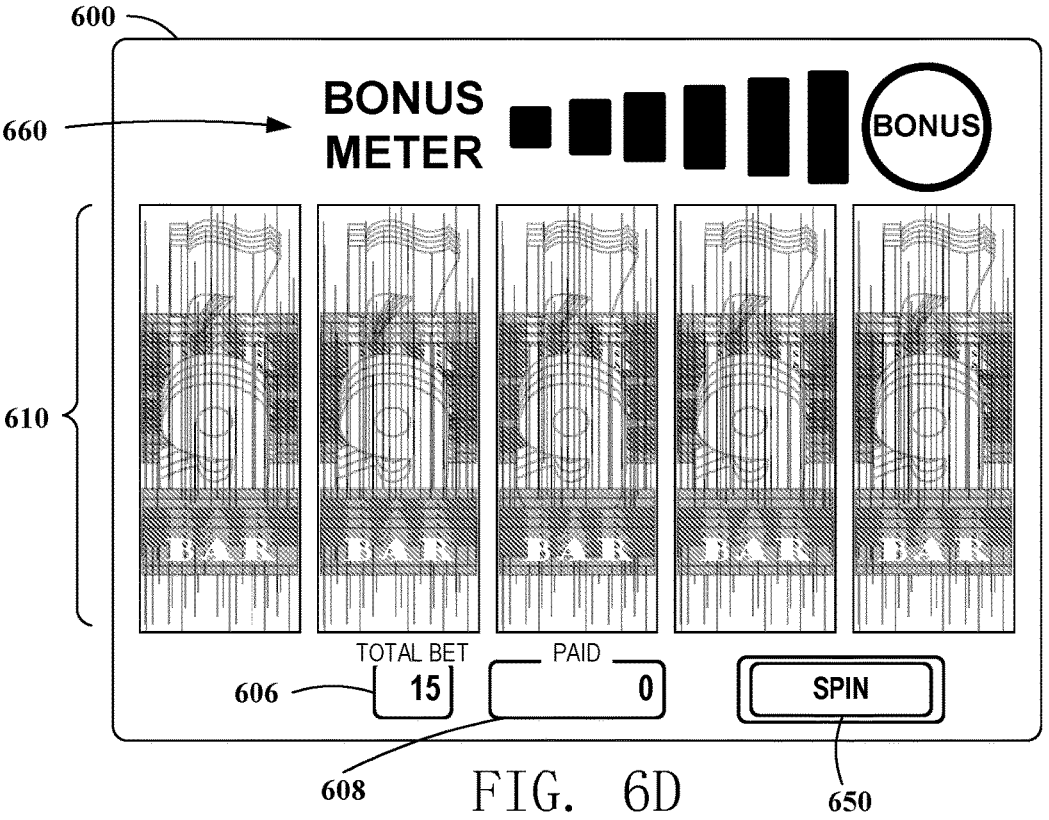
Figure 6E:
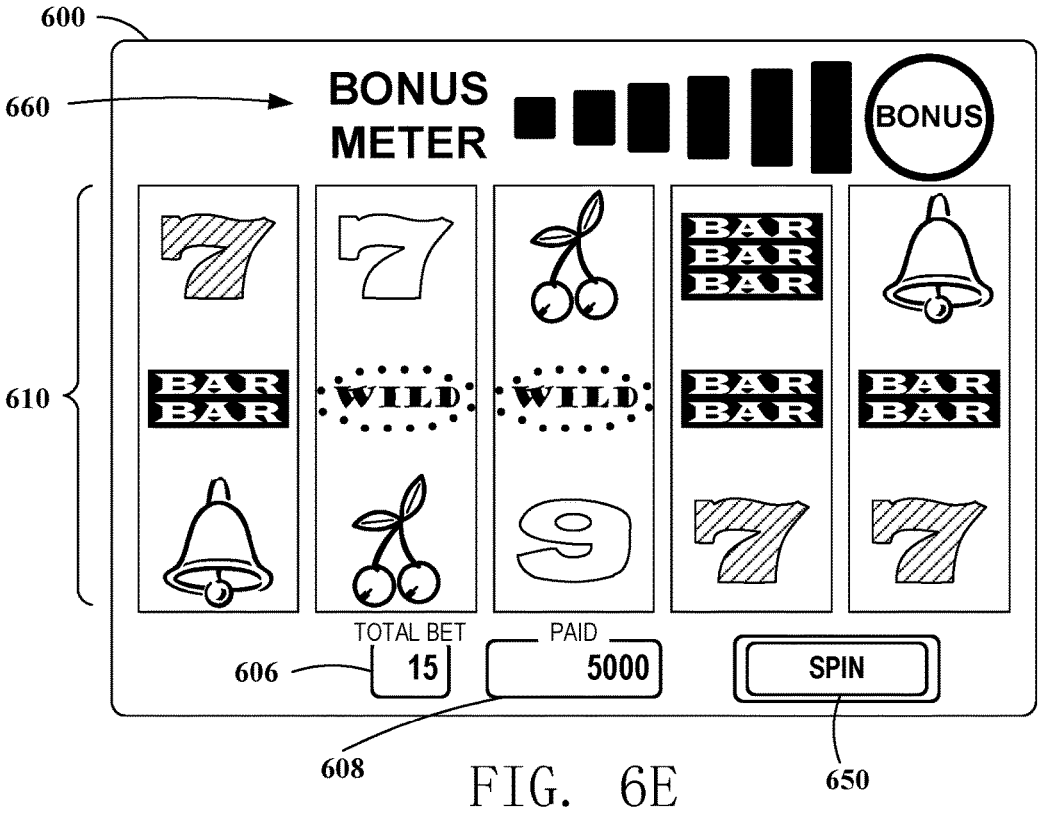
Figure 6F:
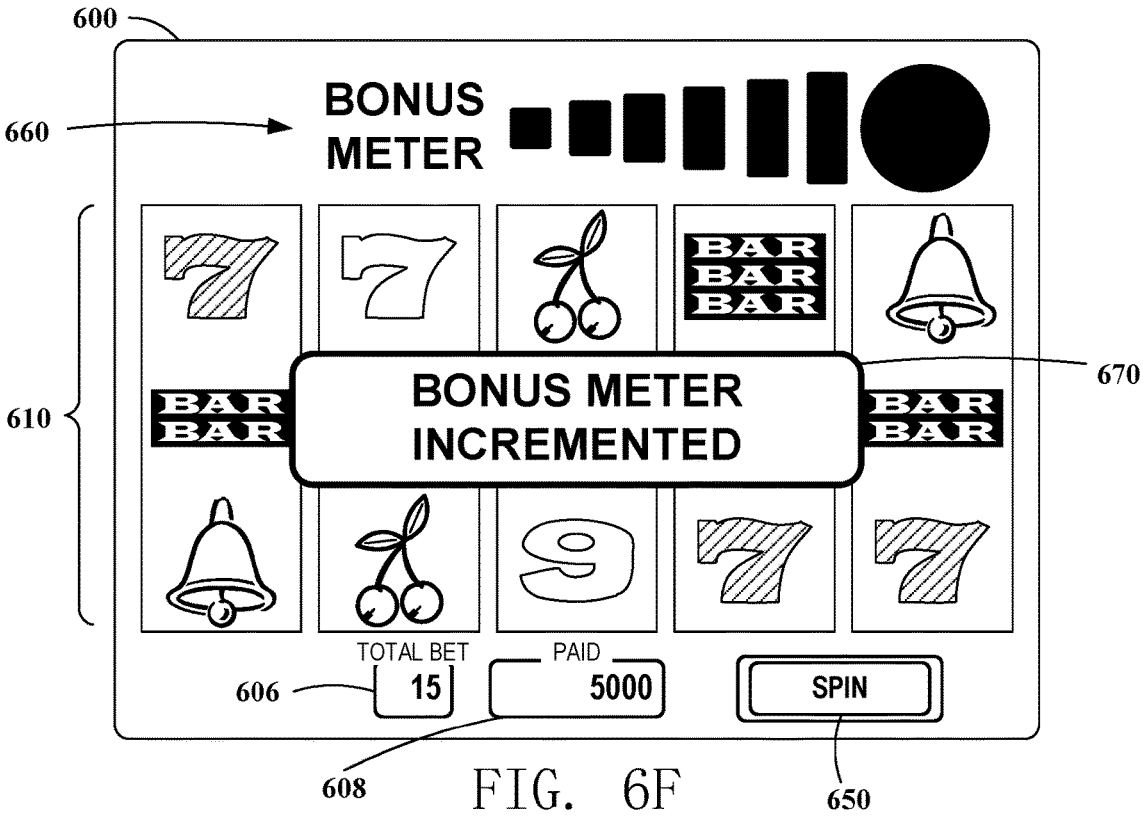
Figure 6G:
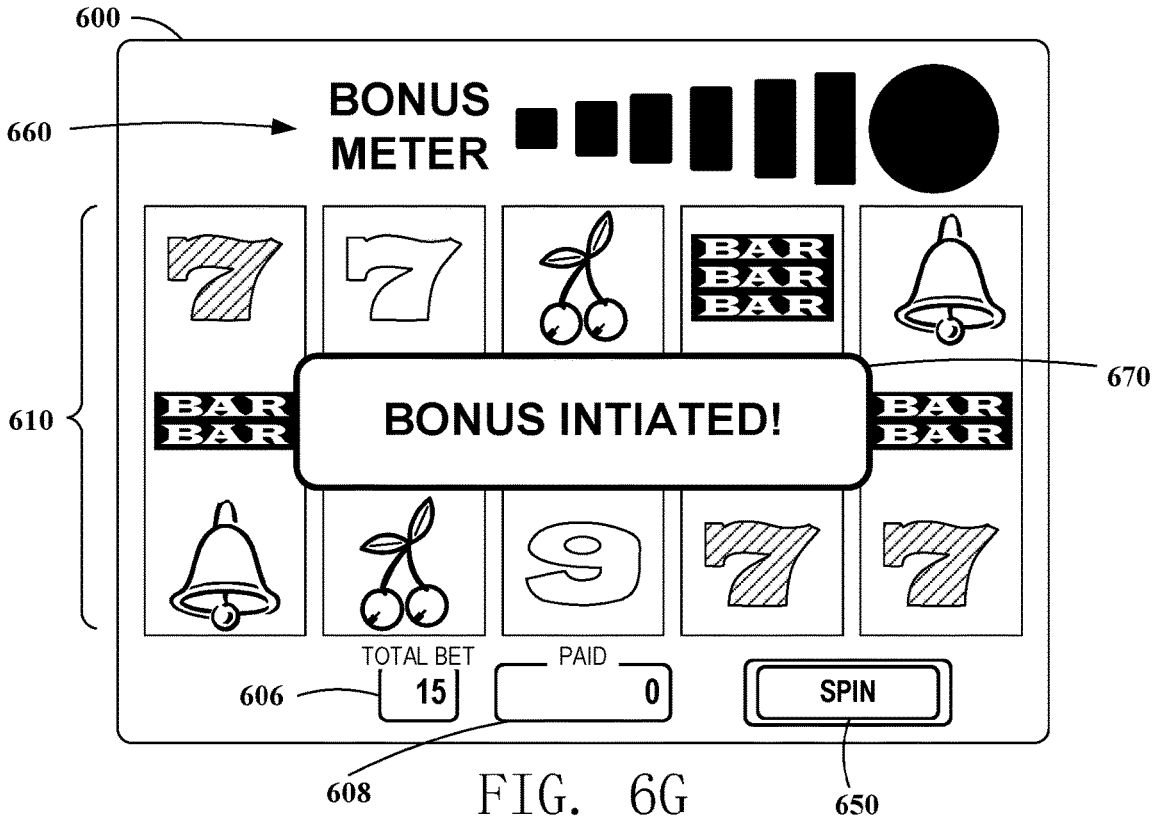

As shown in FIG. 6A, the bonus award meter 660 already has a number of segments marked, and another game has been wagered on and the reels spun. In FIG. 6B, the game outcome on the game grid 610 shows a game outcome (five shaded-7s) associated with an award over a win cap value. In FIG. 6C, an award notification 670 informs the player that the bonus meter 660 is being incremented. The maximum award given the win cap is also provided to the player, as shown in the Paid Meter 608. In FIG. 6D, another game is wagered on and played. As shown in FIG. 6E, another winning combination of symbols is received with an award that exceeds a win cap level. Here, the win cap amount of the award is provided in the Paid Meter 608, and as shown in FIG. 6F, the bonus award meter 660 is incremented, along with providing notification to the player of this incrementation via the award notification 670. In FIG. 6G, the next game is wagered on, and the bonus is immediately initiated prior to spinning the reels in the game grid 610. In other embodiments, the bonus may be initiated after the reels are spun and another game outcome is determined. In either of these embodiments, the bonus, or other prizes may be pushed back to other games. This push back may be dependent on a receiving an otherwise non-winning symbol outcome in the game grid 610, or may be pushed back if another large prize is won during the game.

Figure 7A:
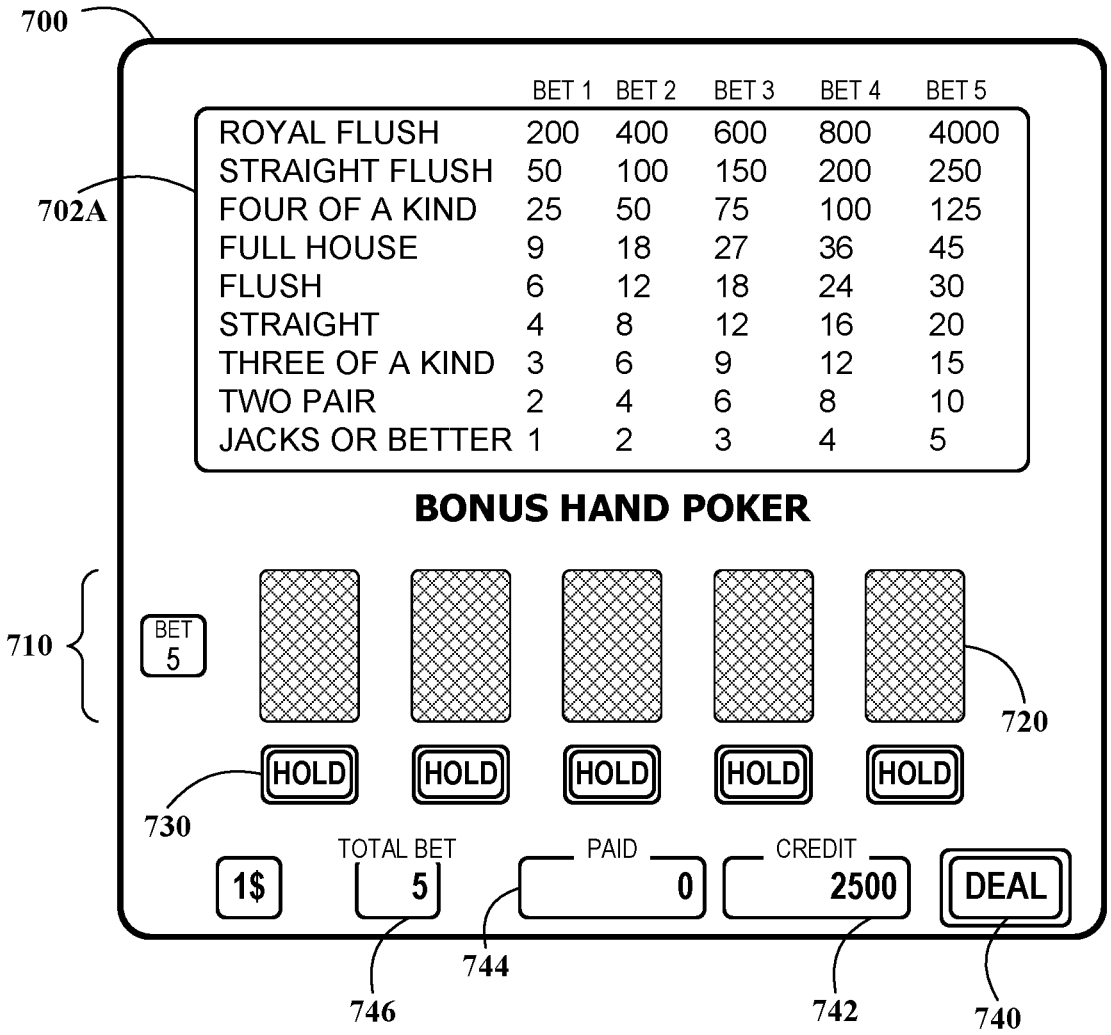
FIGS. 7A, 7B, and 7C are detail diagrams of a gaming display or portion of a gaming display showing a video poker embodiment that uses remainders of capped awards in future games according to embodiments of the invention.
Figures 7B, 7C:
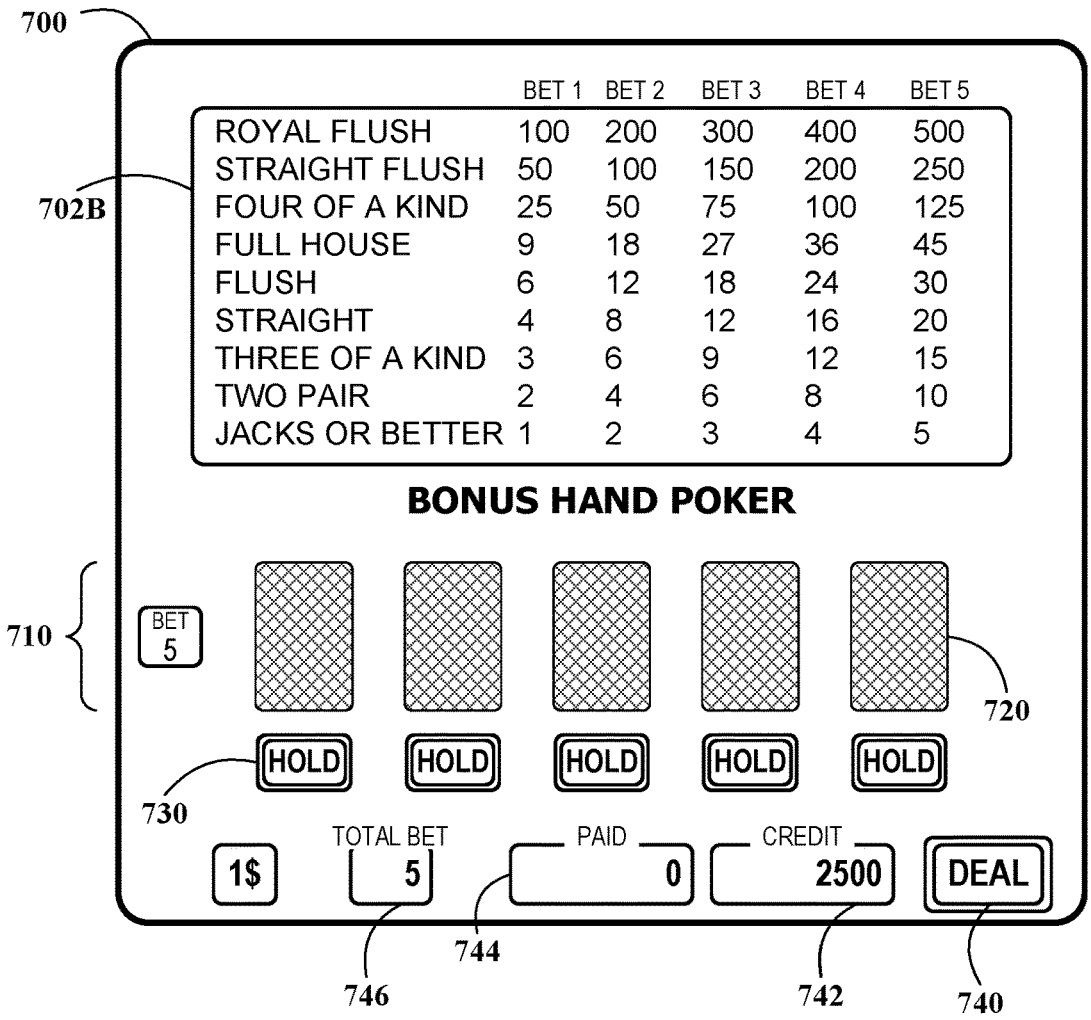

FIGS. 7A, 7B, and 7C are detail diagrams of a gaming display or portion of a gaming display showing a video poker embodiment that uses remainders of capped awards in future games according to embodiments of the invention. Referring to FIG. 7A, a video draw poker gaming device has a display 700 that includes a first paytable 702A, a game grid 710 including five card positions 720, and a player interface portion that includes a "Hold" button 730 for each card position, a Total Bet meter 746, a Paid meter 744, a Credit meter 742, and a Deal/Draw button 740. The first paytable 702A shown in FIG. 7A is a standard paytable used when there is no win cap, or when the win cap is at or above $4000 (it is a $1 denomination machine and the highest award possible for any one game is 4000 credits). If a switch is activated, or an option in software or firmware is selected to indicate a win cap of $500, a paytable may be modified to fit within the win cap amounts, such as shown in the second paytable 702B shown in FIG. 7B. Here, each of the Royal Flush pays has been reduced even though some of the royal flush pays in the first paytable were below the $500 win cap. This may be done to keep the award values somewhat proportional to the bet size. To compensate for the reduction in pay amount for royal flushes, a bonus may be implemented any time a royal flush is won. This bonus may be mystery credits won on the next "x" number of games until the full amount of the royal flush win is paid off, may be a multiplier awarded for a set number of games played after winning the royal flush, or may be another type of bonus. In another example shown by the third paytable 702C in FIG. 7C, a paytable with a $100 win cap may just cap any win from the first paytable 702A above $100 at $100. The remainder value between the value of the award in the first paytable 702A and the capped award shown in the third paytable 702C may be used to modify an aspect of future games as discussed herein.

Figure 8A:
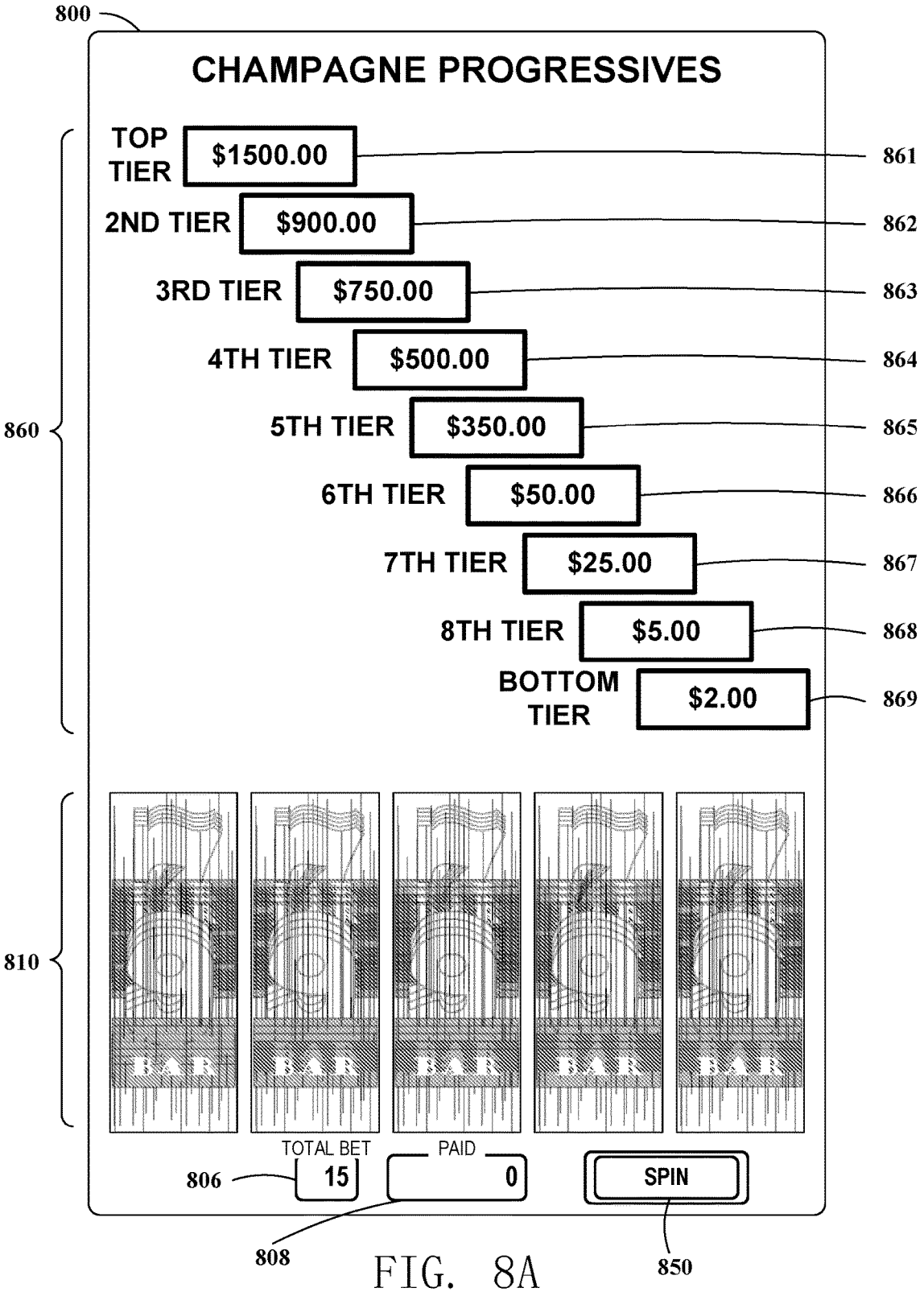
FIGS. 8A and 8B are detail diagrams of a gaming display showing another example game sequence that uses remainders of capped awards in future games according to embodiments of the invention.
Figure 8B:
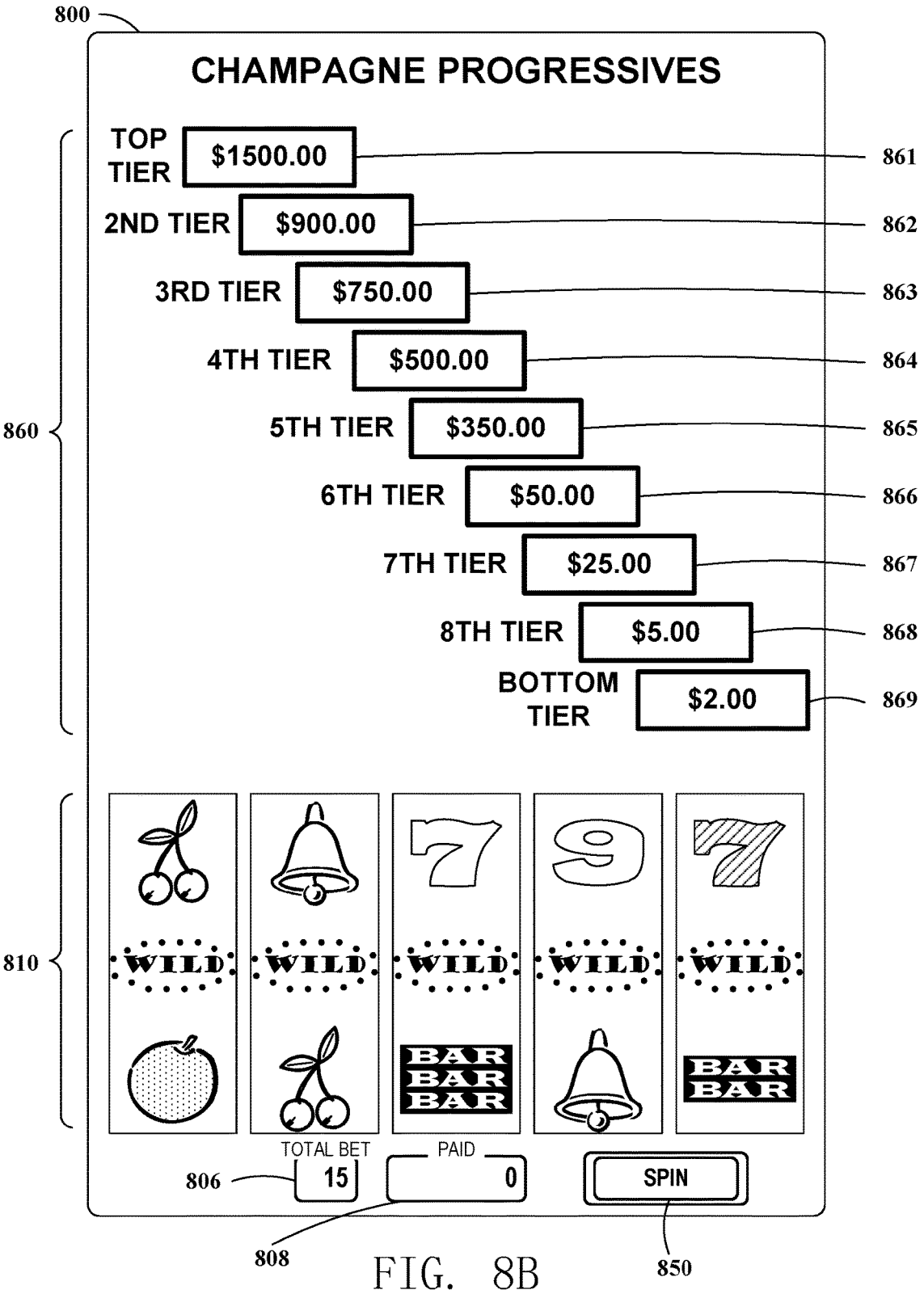

FIGS. 8A and 8B are detail diagrams of a gaming display showing another example game sequence that uses remainders of capped awards in future games according to embodiments of the invention.

Referring to FIGS. 8A and 8B, a gaming display 800 includes a game grid 810 that includes five game reels each having multiple game symbols. A player interface portion of the display 800 includes meters and interactive buttons, such as Total Bet Meter 806, Paid Meter 808, and Spin Button 850. In this embodiment, the gaming display 800 also includes multiple tiered progressive meters 860. These progressive meters 860 start at a "Top Tier" progressive 861, then move sequentially to a "2nd Tier" progressive meter 862, a "3rd Tier" progressive meter 863, a "4th Tier" progressive meter 864, a "5th Tier" progressive meter 865, a "6th Tier" progressive meter 866, a "7th Tier" progressive meter 867, an "8th Tier" progressive meter 868, and a "Bottom Tier" progressive meter 869. Each of these progressive meters 860 may be won by a symbol combination or mystery trigger. In this embodiment, it is much more likely that the Bottom Tier progressive 869 hits than the Top Tier progressive 861. Thus, the amount of the Bottom Tier progressive 869 is much lower than the Top Tier progressive 861. In other words, as the hit frequency of the progressive meters 860 increases, the amount of the meters generally decreases. The progressive meters 860 may be incremented up from starting values, where the incrementation is proportionally applied during play of the game, or where the incrementation is due to certain symbols or other triggers that occur during game play. In this embodiment, suppose there is a win cap of $1000.

In FIG. 8A, a game is wagered on and initiated as indicated by the spinning reels in the game grid 810. In FIG. 8B, the reels stop and the game grid 810 shows that a Top Tier progressive has been won (5 wild symbols on a pay line). FIGS. 8C-i, 8C-ii, and 8C-iii are detail diagrams of the gaming display illustrated in FIGS. 8A and 8B showing alternate example next steps in the game sequence illustrated in FIGS. 8A and 8B according to embodiments of the invention.

In FIG. 8C-I, an amount over the win cap cascades down the progressive meters 860 until it can be used to bump up the meters to $500. Here, since the Top Tier progressive was $1500 and the win cap was $1000, we have a $500 remainder to distribute down the tiered progressives 860. The 2nd Tier progressive 862, 3rd Tier progressive 863, and 4th Tier progressive 864 are all over $500, so the remainder value of $500 continues down the tiered progressives. However, the 5th Tier progressive 865 is below $500, so its value of $350 is increased to $500, thereby using $150 of the remainder. The 6th Tier progressive 866 is next, and the remaining $350 of the remainder is used to bump the value of the 6th Tier progressive up from $50 to $400. Since the 5th Tier progressive 865 and 6th Tier progressive may be won relatively often, a player may be inclined to continue playing the game with bumped up values in these progressive meters. Additionally, the value not won from the Top Tier progressive is not just simply lost, but reapportioned in the game where it can be won later. Note that the Top Tier progressive meter 861 is reset to a starting value, which is this embodiment is $500.

In FIG. 8C-ii, any remainder due to a win cap is applied to the next progressive meter 860 until it runs in the win cap of $1000. Thus, the $500 remainder is applied the 2nd Tier progressive 862 to push its value to $1000 (using $100 of the remainder), then applied to the 3rd Tier progressive meter 863 to push its value to $1000 (using $250 of the remainder), and then applied to the 4th Tier progressive meter 864 (the remaining $150 of the remainder).

In FIG. 8C-iii, any remainder due to a win cap is used to bump up the value of a progressive meter 860 as selected by a player. This gives the player the ability to bump up the value of easier-to-win progressive meters by lower amounts, or significantly bump up the values of harder-to-win progressive meters. These selections may be provided to the player in an award message box 870 with a plurality of selectable buttons.

FIGS. 9A, 9B, 9C, and 9D are detail diagrams of a gaming display showing another example game sequence that uses remainders of capped awards in future games according to embodiments of the invention.

Figure 9A:
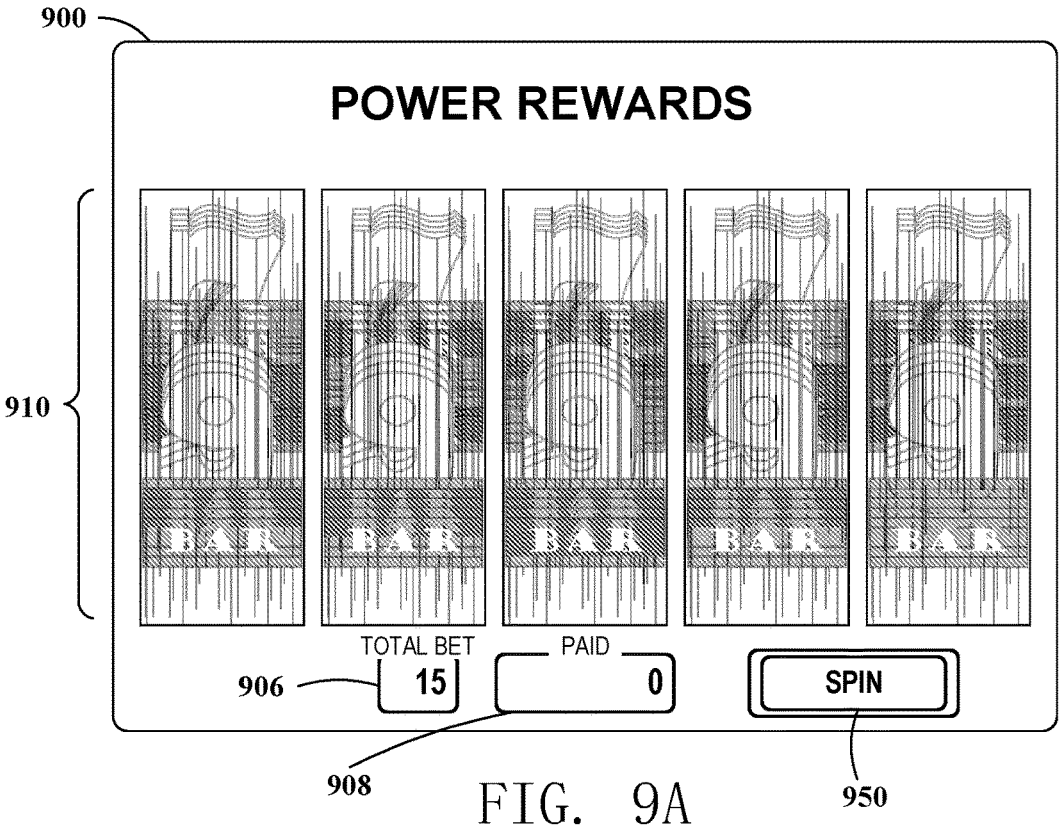
FIGS. 9A, 9B, 9C, and 9D are detail diagrams of a gaming display showing another example game sequence that uses remainders of capped awards in future games according to embodiments of the invention.
Figure 9B:
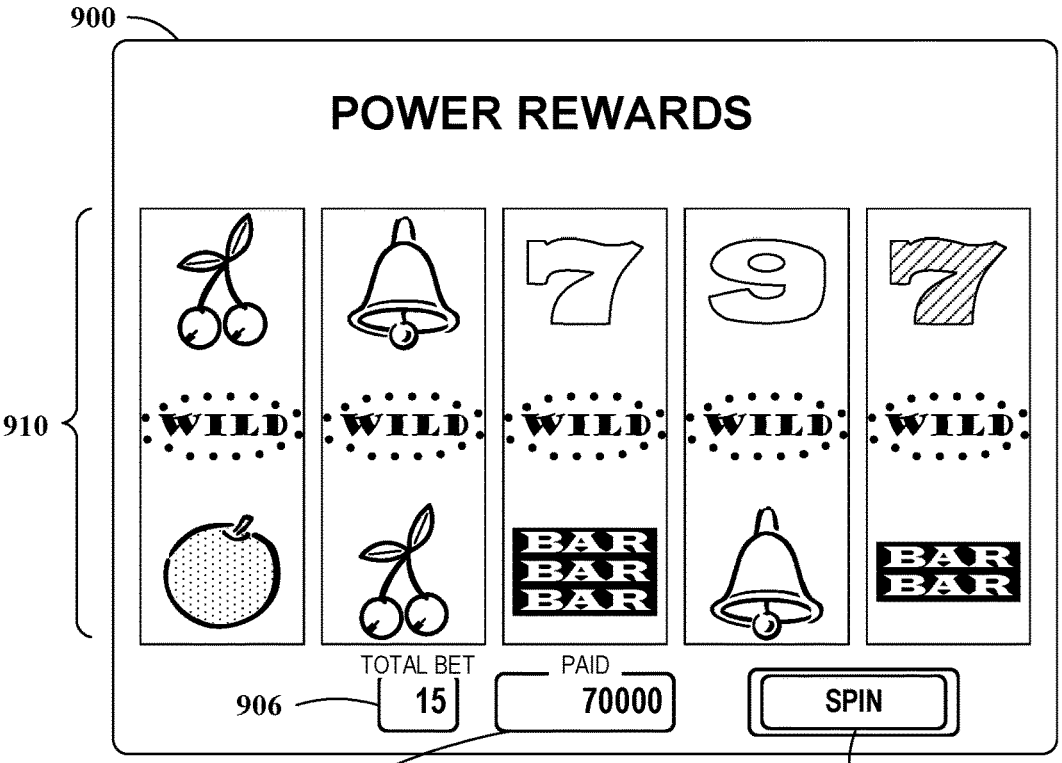
Figure 9C:
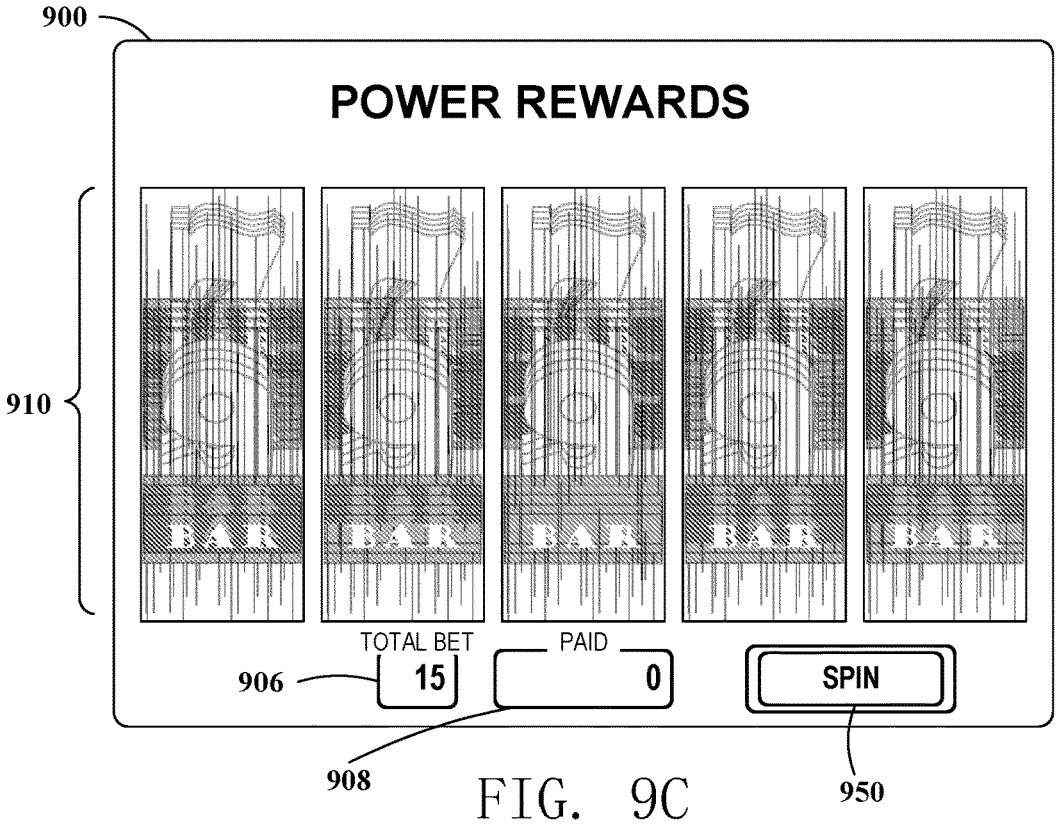
Figure 9D:
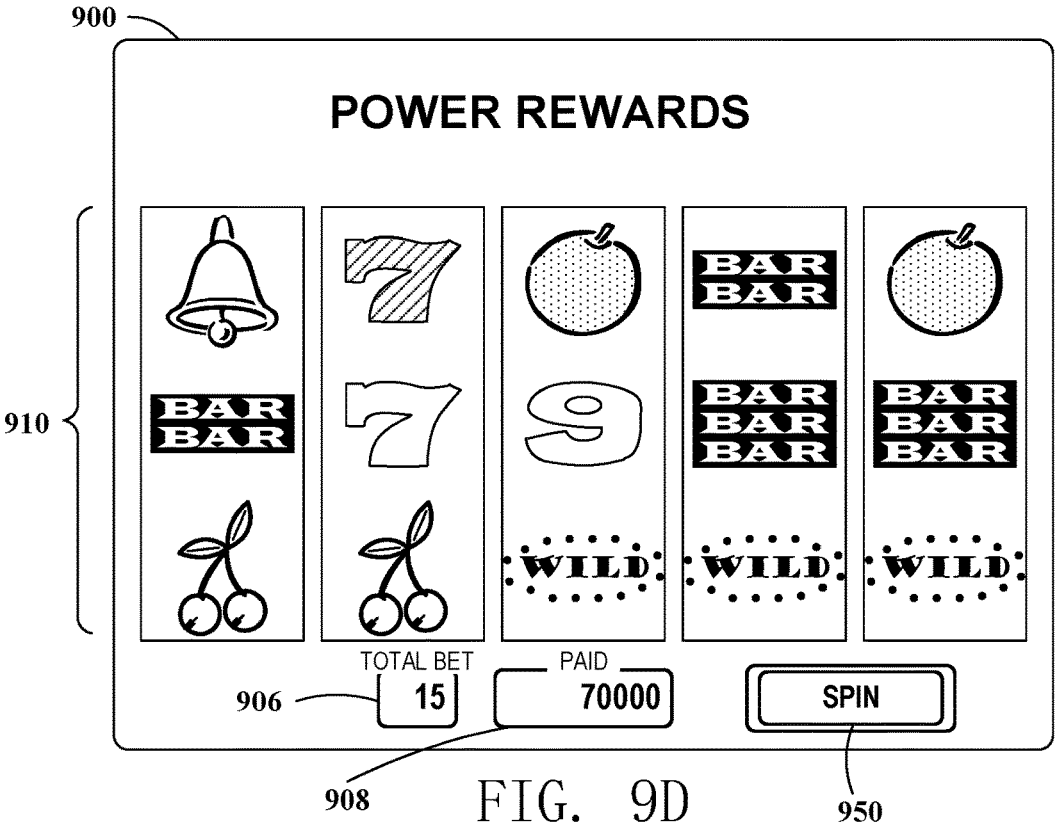

Referring to FIGS. 9A-9D, a gaming display 900 includes a game grid 910 that includes five game reels each having multiple game symbols. A player interface portion of the display 900 includes meters and interactive buttons, such as Total Bet Meter 906, Paid Meter 908, and Spin Button 950. In this embodiment, a win threshold is used to push any prizes to a win cap amount. In this example, a win cap of $700 is required, and a win threshold of $500 is set. Here, any win over the win threshold automatically gets paid the win cap amount. The win threshold may be variable and settable by a casino operator or game designer. In FIG. 9A, a game is initiated. In FIG. 9B, a jackpot award is won with a value that is typically $2500. However, because this value is over the win threshold of $500, the win is automatically capped to the win cap amount of $700, as shown in the Paid Meter 908 (using penny denomination). In FIG. 9C, another game is initiated. In FIG. 9D, a nice symbol combination award of $525 is won. However, because this award is over the win threshold, the player is awarded the win cap amount of $700, as shown in the Paid Meter 908 again. Embodiments using this mechanic can be advantageous because many more wins are likely to occur between the win threshold amount and the win cap amount than wins over the win cap amount. In some embodiments, the win threshold amount may be variable depending on the state of the game. That is, wins that exceed the win cap amount may work to lower the win threshold amount and increase the likelihood of wins being bumped up to the higher win cap amount. Similarly, wins that fall between the win threshold amount and win cap amount may raise the win threshold amount for subsequent games. In other embodiments, the win threshold amount may be variable based on other conditions, such as special symbols landing in the game grid 910, bonuses won, coins bet, player loyalty status, etc.

FIG. 10 is a flow diagram illustrating a method of using a gaming device or system to implement a point mechanic for capped awards and remainders according to embodiments of the invention. Referring to FIG. 10, flow 1000 begins at process 1010 where a wager is received and a game of chance is initiated on a gaming device. This process may include receiving signals that a wager has been placed on the game of chance and reducing credit amount stored in a memory of the gaming device by the amount wagered. In process 1020, the gaming device determines is an award has been won during play of the game of chance. Process 1020 may include randomly determining a game outcome for the game of chance using a random number generator, and evaluating game symbols that appear in a game grid (such as slot symbols visible in a symbol position, cards in a video poker hand, or other game indicia in a game outcome) to determine if an award is associated with any combinations in the game grid using a predetermined paytable. If an award is not won, flow 1000 returns to process 1010 to await the receipt of another wager, another game trigger, or a player command. If an award is won as determined in process 1020, flow 1000 proceeds to process 1030 where the points awarded in process 1020 are converted to credits. As discussed above, there are many different methods of converting points to credits, such as using lookup tables, algorithms, or other conversion techniques.

In optional process 1040, a determination is made if a bonus is triggered based on the point conversion. For example, if process 1030 includes an algorithm that converts points to credits on a 1-to-1 basis for points up to 100,000 on a penny machine having a win cap of $1000, and awards a bonus for a subsequent game for any points won above 100,000 (for example, awarding a free games bonus on the next game where a free game is awarded for each additional 10,000 points won), a bonus may be won based on the points awarded. If a bonus is won, flow 1000 proceeds to optional process 1050 where the bonus is implemented based on the points.

Figure 11A:
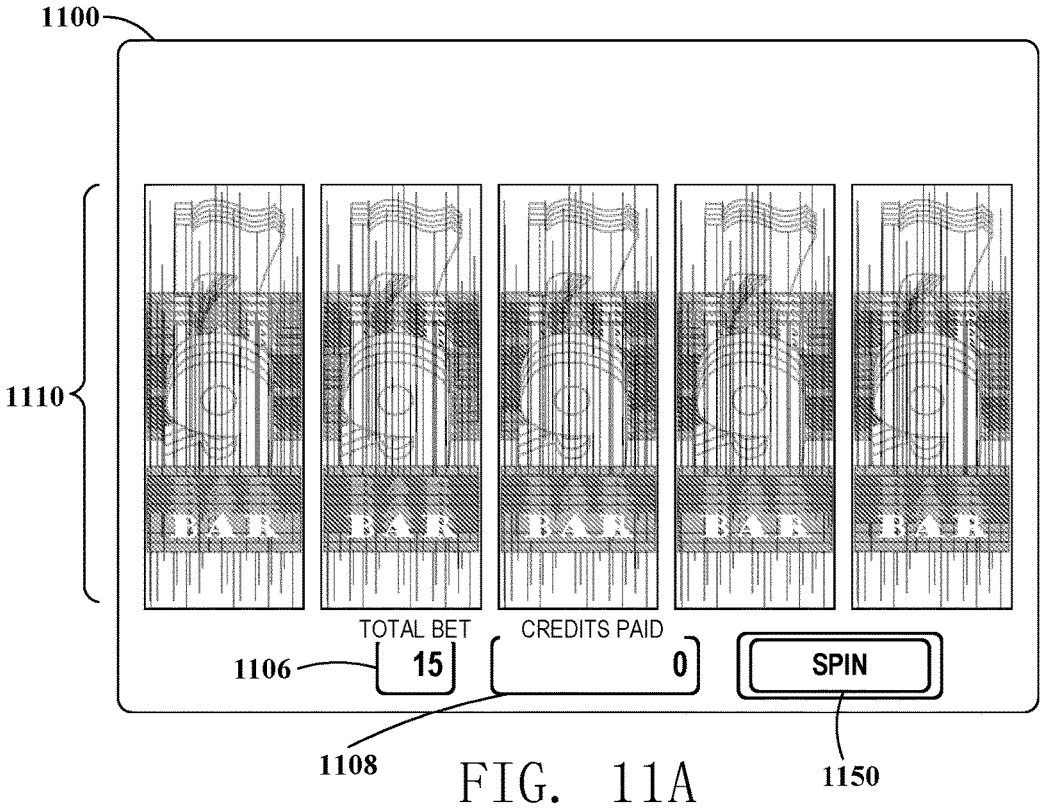
FIGS. 11A, 11B, and 11C are detail diagrams of a gaming display showing an example game sequence that implements a point mechanic for capped awards and remainders according to embodiments of the invention.
Figure 11B:
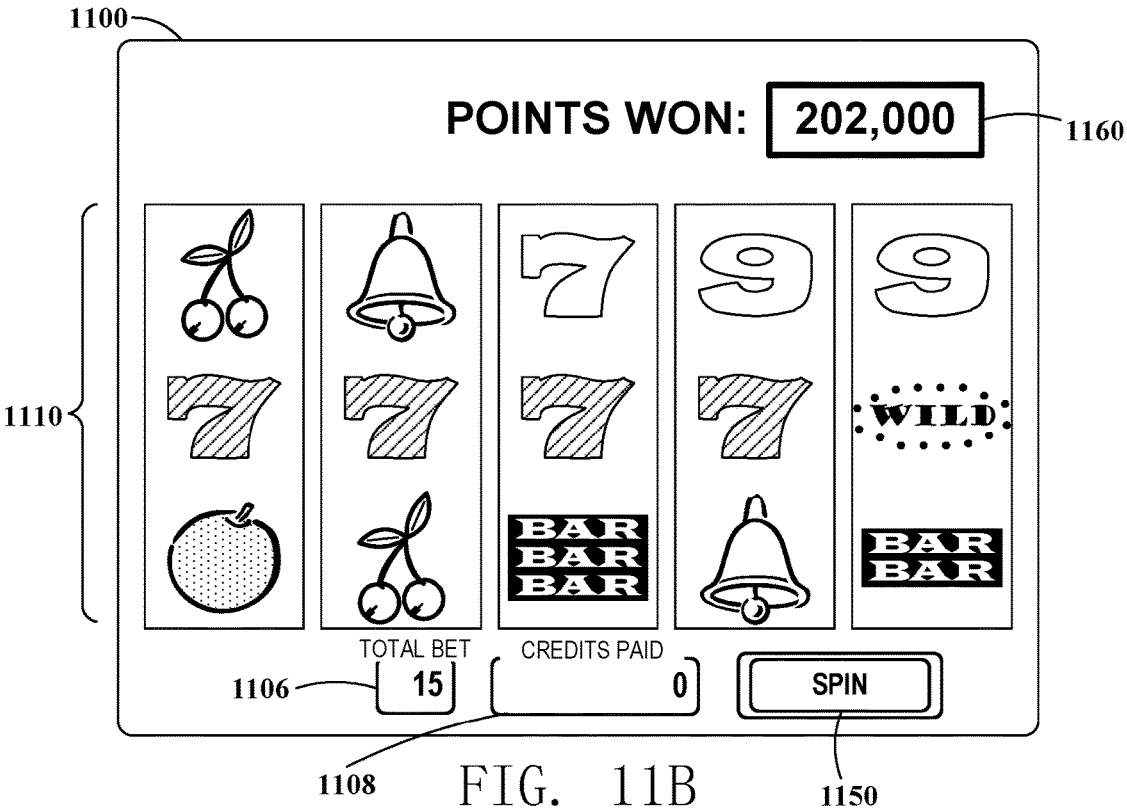
Figure 11C:
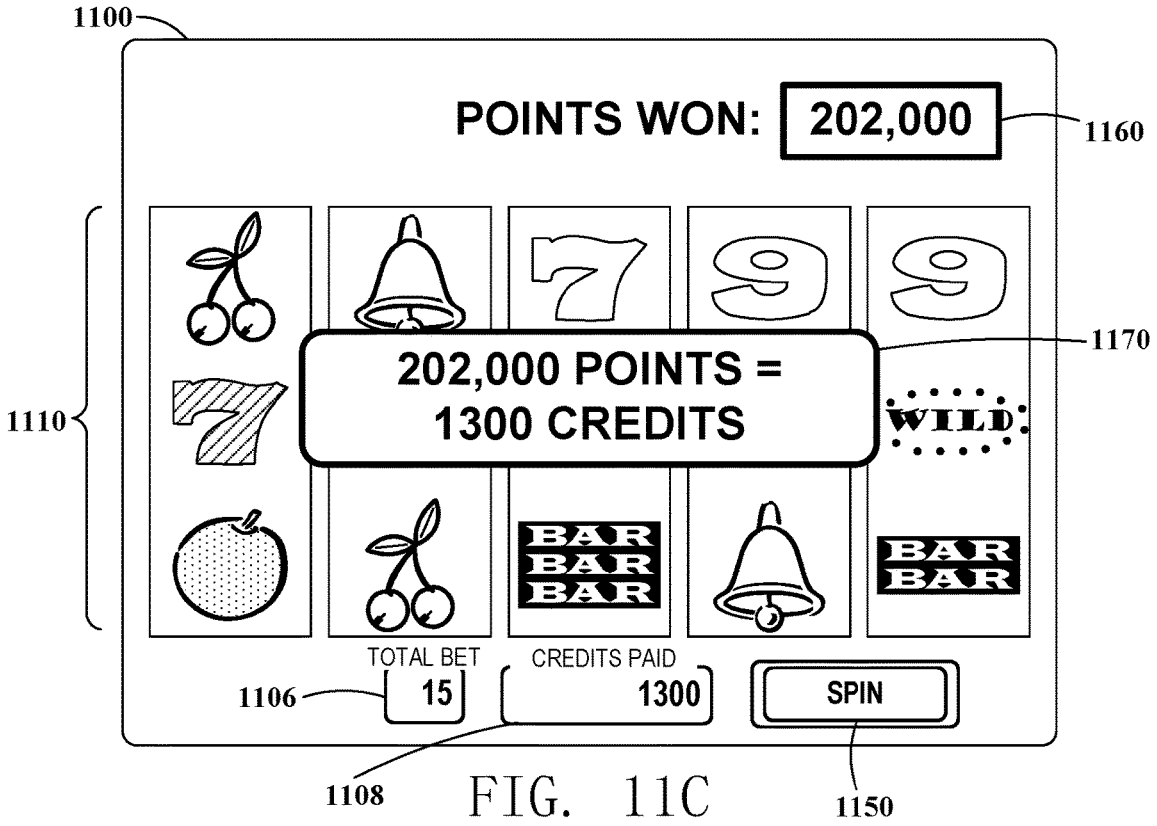

FIGS. 11A, 11B, and 11C are detail diagrams of a gaming display showing an example game sequence that implements a point mechanic for capped awards and remainders according to embodiments of the invention.

Referring to FIGS. 11A-11C, a gaming display 1100 includes a game grid 1110 that includes five game reels each having multiple game symbols. A player interface portion of the display 1100 includes meters and interactive buttons, such as Total Bet Meter 1106, Credits Paid Meter 1108, and Spin Button 1150. In this embodiment, a game is configured in which the first 100,000 points translate to credits as 1 credit for every 1000 points; the next 100,000 points translate as 1 credit for every 100 points; and any additional points translate as 1 credit for every 10. In FIG. 11A, a game is initiated. In FIG. 11B, the game outcome is shown along with the point value associated with the game outcome of 202,000 points, as shown in the Points Won meter 1160. As shown in FIG. 11C, an award window 1170, shows the conversion of the points to credits using the algorithm described above. Here, 202,000 points equals 1300 credits, which are also shown in the Credits Paid Meter 1108.

FIGS. 12A, 12B, 12C, 12D, 12E, and 12F are detail diagrams of a gaming display showing an example game sequence that implements a point mechanic for capped awards and remainders according to embodiments of the invention.

Referring to FIGS. 12A-12F, a gaming display 1200 includes a game grid 1210 that includes five game reels each having multiple game symbols. A player interface portion of the display 1200 includes meters and interactive buttons, such as Total Bet Meter 1206, Credits Paid Meter 1208, and Spin Button 1250. In this embodiment, a game is configured in which the first 100,000 points translate to credits as 1 credit for every 100 points; the next 100,000 points translate as 1 credit for every 10 points; and any additional points translate as 1 credit for every 10. Additionally, some symbol combinations (or all symbol combinations) are associated with a category. Here, some symbols are considered "Shaded Symbols" and some symbols are considered "Solid Symbols," although they could be based on color, size, value, major/minor, picture/royal, etc. Winning symbol combinations using symbols that are part of the Shaded Symbol category increment a Shaded Point Meter 1262, while winning symbol combinations using symbols that are part of the Solid Symbol category increment a Solid Point Meter 1264. At the end of the game, the meter with the higher point total has that point total converted into credits, which are won by the player. In some embodiments, a special symbol or other trigger may be utilized where the sum of all the points in both meters is converted to credits. In this embodiment, if a special "Power Plus" symbol lands in the symbol grid 1210, the points from both point meters 1262, 1264 are combined and converted to credits to be provided to the player.

Figure 12A:
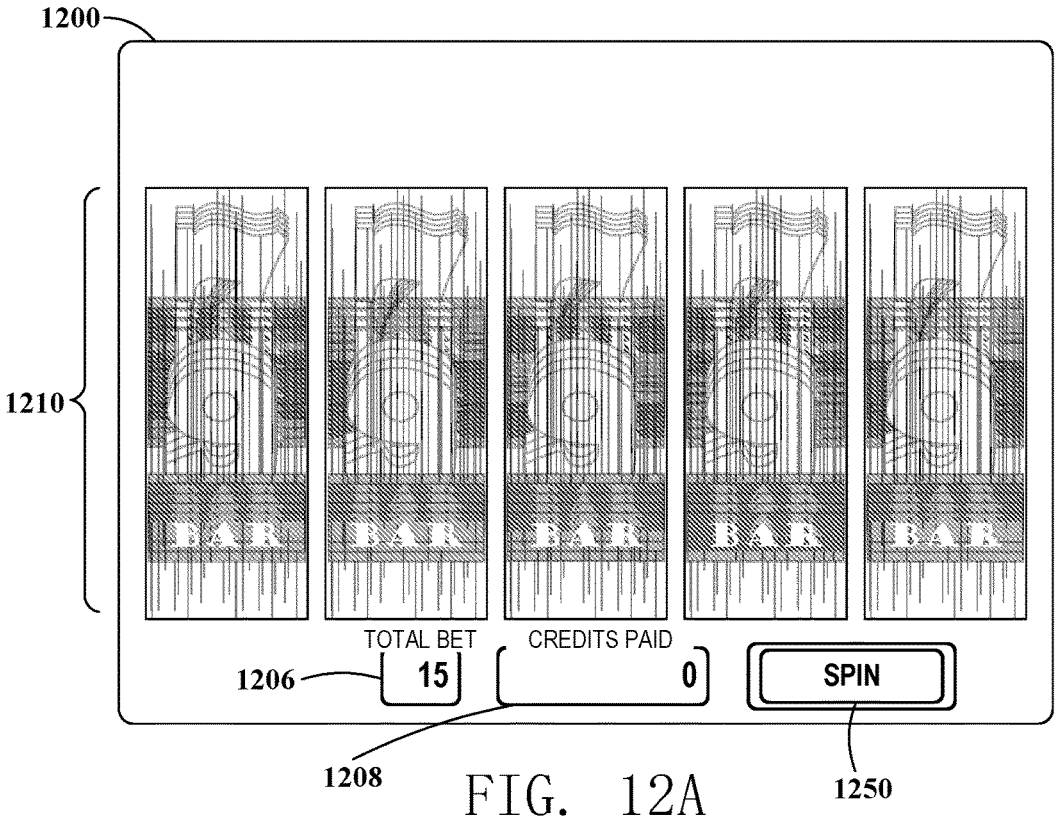
FIGS. 12A, 12B, 12C, 12D, 12E, and 12F are detail diagrams of a gaming display showing an example game sequence that implements a point mechanic for capped awards and remainders according to embodiments of the invention.
Figure 12B:
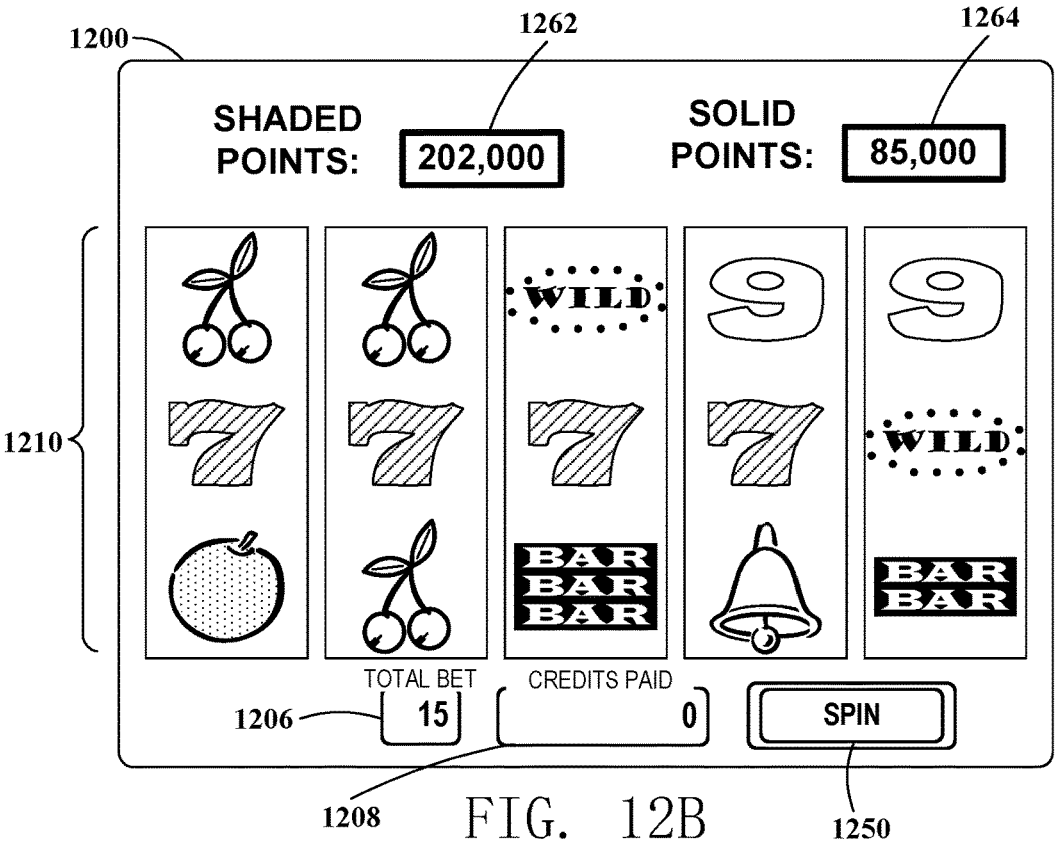
Figure 12C:
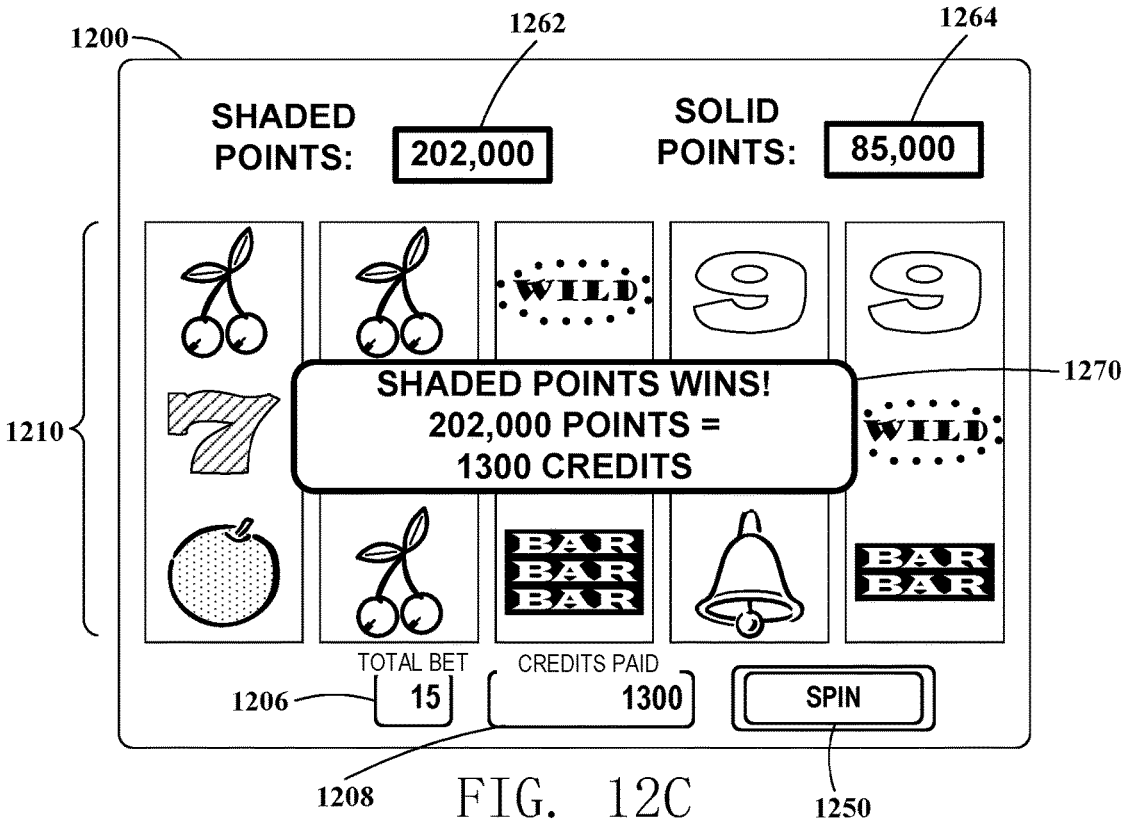

In FIG. 12A, a game is initiated. In FIG. 12B, 5 Shaded-7s (shaded symbols) are received with a point value of 202,000 points and 3 cherries (solid symbols) are received with a point value of 85,000 points. As shown in FIG. 12C, since the point value in the Shaded Point Meter 1262 is larger than the value in the Solid Point Meter 1264, the shaded point total of 202,000 credits is awarded and converted into credits. This is communicated to the player in the award notice 1270 and the 1300 credits won are applied to the Credits Paid Meter 1208.

Figure 12D:
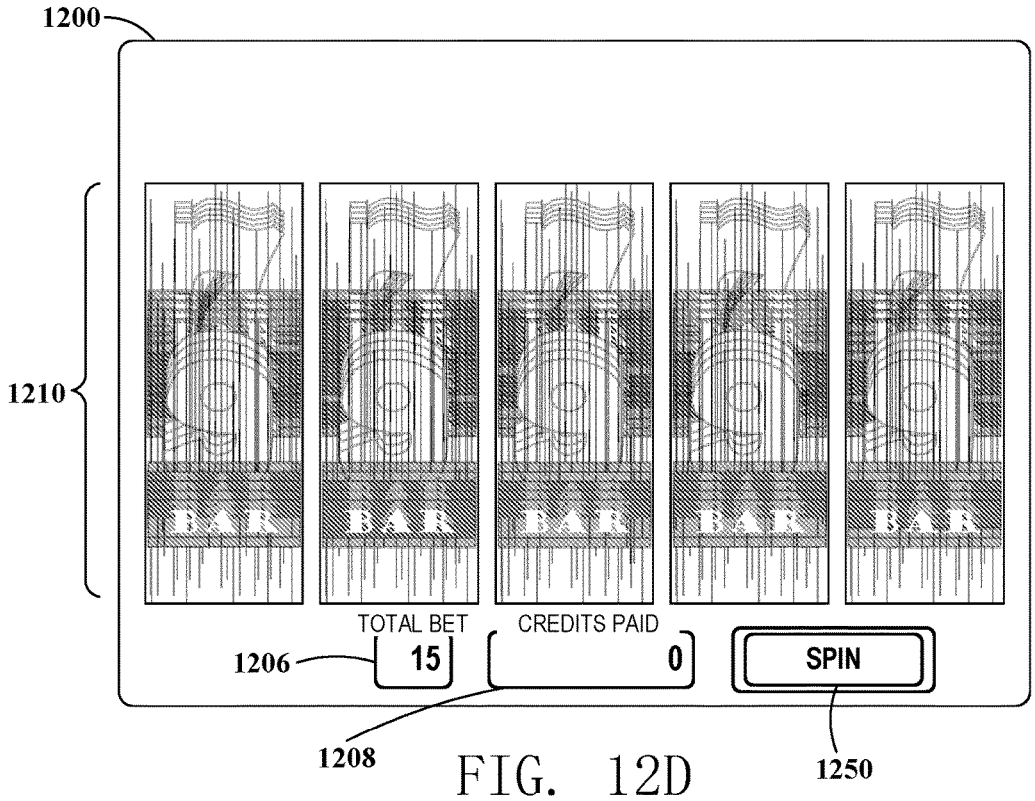
Figure 12E:
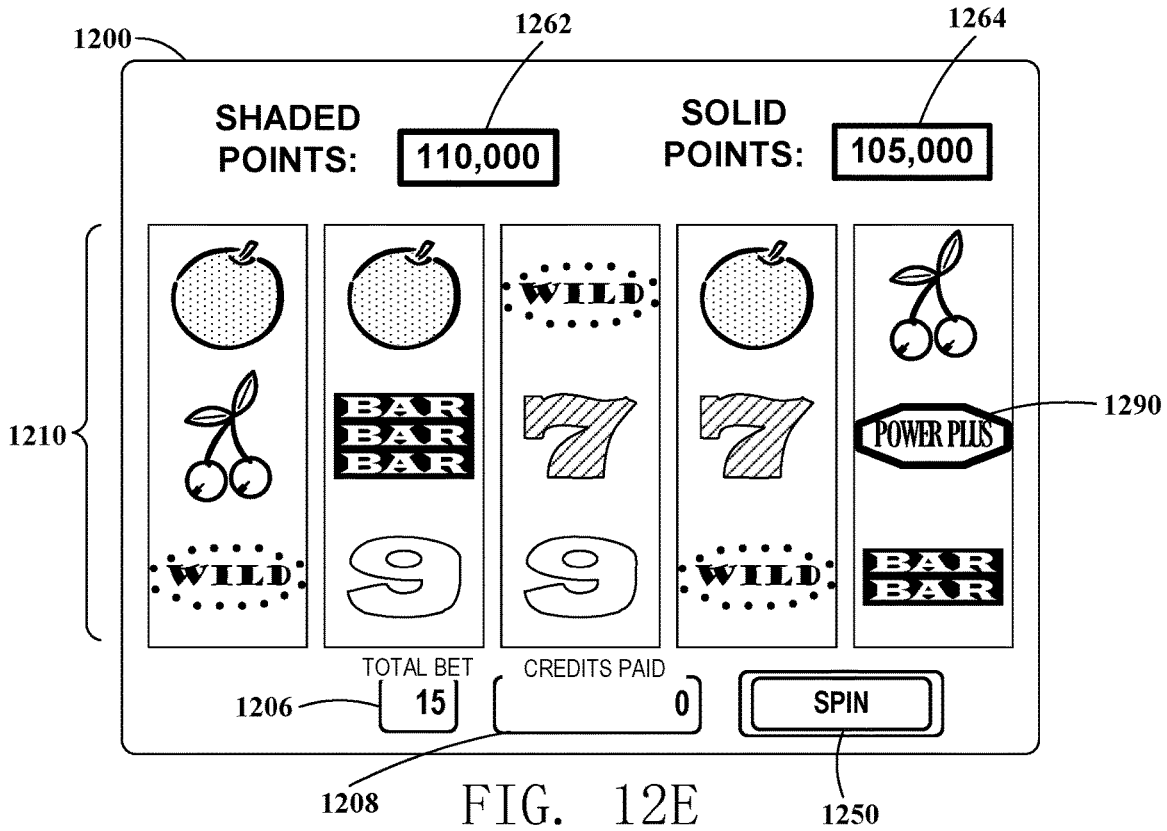
Figure 12F:
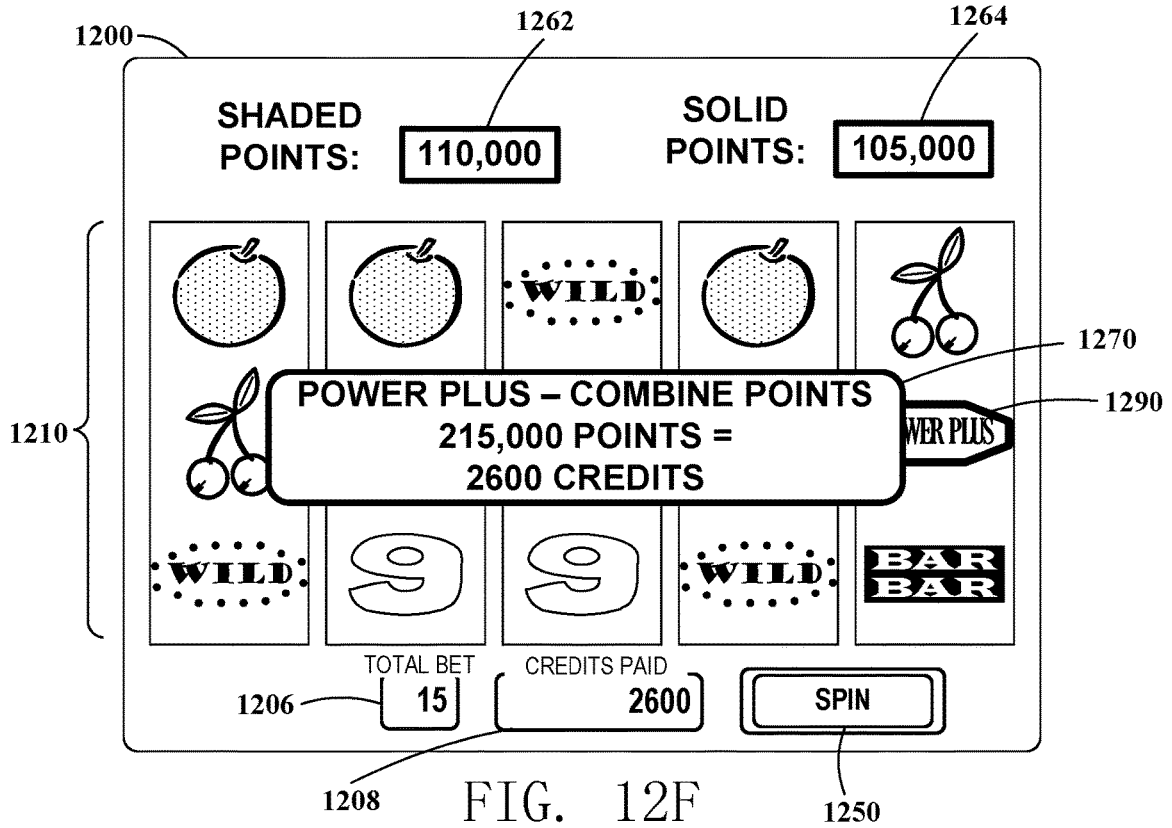

In FIG. 12D, another game is initiated. In FIG. 12E, 4 Oranges (shaded symbols) are received with a point value of 110,000 points and 4 Solid-9s (solid symbols) are received with a point value of 105,000 points. In addition, the Power Plus symbol 1290 appears in the game grid 1210. Thus, as shown in FIG. 12F, the points in the two point meters 1262, 1264 are combined and converted into credits. This is communicated to the player in the award notice 1270 and the 2600 credits won are applied to the Credits Paid Meter 1208.

The foregoing description of the exemplary embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A gaming device comprising:

a display device;

a memory configured to store a credit amount;

a wager input device structured to receive physical items associated with a currency value; and a processor operable to:

receive a first signal from the wager input device indicating receipt of a physical item associated with a currency value;

increase the credit amount stored in the memory based upon the received signal from the wager input device;

receive a second signal indicating a wager amount to initiate a game on the gaming device, the credit amount stored in the memory reduced based on the wager amount;

determine a first game outcome;

display the first game outcome on the display device;
evaluate the first game outcome to determine a first award amount associated with the first game outcome;
determine if the first award amount is greater than a predefined maximum award amount; and
when the first award amount is greater than the predefined maximum award amount:
provide a second award amount substantially equal to the predefined maximum award amount, the credit amount stored in the memory increased based on the second award amount,
determine a first remainder amount equal to the difference between the first award amount and the predefined maximum award amount, and
modify at least one aspect of a future game based on the first remainder amount.

2. The gaming device of claim 1, wherein modifying the at least one aspect of a future game based on the first remainder amount includes increasing a reset value for a first progressive award in the future game.

3. The gaming device of claim 2, wherein the reset value of the first progressive award is increased by the value of the first remainder amount.

4. The gaming device of claim 2, wherein modifying the at least one aspect of a future game based on the first remainder amount includes increasing a reset value for a first progressive award and increasing a reset value for a second progressive award in the future game.

5. The gaming device of claim 4, wherein the reset value of the first progressive award is increased by a first portion of the first remainder amount, and the reset value of the second progressive award is increased by a second portion of the first remainder amount.

6. The gaming device of claim 1, wherein the processor is further operable to:
determine if the first remainder is greater than a predefined maximum remainder amount; and
determine a second remainder amount equal to the difference between the first remainder amount and the predefined maximum remainder amount.

7. The gaming device of claim 6, wherein modifying the at least one aspect of the future game is based on the first remainder amount and the second remainder amount.

8. The gaming device of claim 6, wherein modifying the at least one aspect of the future game includes:
modifying a first aspect of the future game based on the first remainder amount; and
modifying a second aspect of the future game based on the second remainder amount.

9. The gaming device of claim 6, wherein modifying the at least one aspect of the future game includes:
modifying at least one aspect of a first future game based on the first remainder amount; and
modifying at least one aspect of a second future game based on the second remainder amount.

10. The gaming device of claim 1, wherein modifying the at least one aspect of the future game includes providing a multiplier value for the future game.

11. The gaming device of claim 10, wherein modifying the at least one aspect of the future game includes incrementing a bonus meter based on the first remainder amount.

12. The gaming device of claim 1, wherein the processor is further operable to trigger a bonus game in the future game when the bonus meter is incremented past a predefined threshold.

13. The gaming device of claim 1, wherein modifying the at least one aspect of the future game includes increasing one or more award pays in a paytable in the future game.

14. The gaming device of claim 1, wherein modifying the at least one aspect of the future game includes modifying the at least one aspect for a predetermined number of future games.

15. A gaming device comprising:
a display device;
a memory configured to store a credit amount;
a wager input device structured to receive physical items associated with a currency value; and
a processor operable to:
receive a first signal from the wager input device indicating receipt of a physical item associated with a currency value;
increase the credit amount stored in the memory based upon the received signal from the wager input device;
receive a second signal indicating a wager amount to initiate a game on the gaming device, the credit amount stored in the memory reduced based on the wager amount;
determine a first game outcome;
display the first game outcome on the display device;
evaluate the first game outcome to determine a first award amount associated with the first game outcome;
when the first award amount is over a predefined amount:
present the first award amount as an amount of points,
convert the presented amount of points into credits using a predefined algorithm,
present the credits from the converted points to the player, and
increase the credit amount stored in the memory based on the presented credits.

16. The gaming device of claim 15, wherein the predefined amount is zero.

17. The gaming device of claim 15, wherein the algorithm includes randomly assigning a credit value between 1 and 10 for each 100 points awarded for the first award amount.

18. The gaming device of claim 15, wherein the algorithm includes:
awarding credits on a 1-to-1 basis up to a first predefined point amount;
awarding credits on a 1-to-10 basis for point amounts between the first predefined award amount and a second predefined credit amount;
and awarding credits on a 1-to-100 basis for point amounts above the second predefined credit amount.

19. The gaming device of claim 15, wherein the algorithm includes assigning credit values to points based on a category associated with each point for the first award amount.

20. A gaming device comprising:
a display device;
a memory configured to store a credit amount;
a wager input device structured to receive physical items associated with a currency value; and
a processor operable to:
receive a first signal from the wager input device indicating receipt of a physical item associated with a currency value;
increase the credit amount stored in the memory based upon the received signal from the wager input device;

receive a second signal indicating a wager amount to initiate a game on the gaming device, the credit amount stored in the memory reduced based on the wager amount;

determine a first game outcome;

display the first game outcome on the display device;

evaluate the first game outcome to determine a first award amount associated with the first game outcome;

determine if the first award amount is greater than a predefined maximum award amount; and when the first award amount is greater than the predefined maximum award amount:

provide a second award amount substantially equal to the predefined maximum award amount, the credit amount stored in the memory increased based on the second award amount, determine a first remainder amount equal to the difference between the first award amount and the predefined maximum award amount, and provide a game multiplier for a second game based on the first remainder amount.

* * * * *